US006459869B2

(12) United States Patent
Nittani et al.

(10) Patent No.: US 6,459,869 B2
(45) Date of Patent: Oct. 1, 2002

(54) PROCESS CARTRIDGE AND IMAGE FORMING APPARATUS

(75) Inventors: Susumu Nittani, Shizuoka-ken; Kanji Yokomori; Takeshi Arimitsu, both of Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/760,702

(22) Filed: Jan. 17, 2001

(30) Foreign Application Priority Data

Jan. 19, 2000 (JP) ..... 2000-009778
Dec. 22, 2000 (JP) ..... 2000-390778

(51) Int. Cl.[7] ..... G03G 21/18
(52) U.S. Cl. ..... 399/111; 399/113; 399/167
(58) Field of Search ..... 399/111, 112, 399/113, 117, 167

(56) References Cited

U.S. PATENT DOCUMENTS 5,839,028 A 11/1998 Nomura et al. ..... 399/109
5,878,309 A 3/1999 Nomura et al. ..... 399/111
5,940,657 A 8/1999 Yokomori et al. ..... 399/119
5,943,528 A 8/1999 Akutsu et al. ..... 399/110
5,946,531 A 8/1999 Miura et al. ..... 399/111
5,950,049 A 9/1999 Yokomori et al. ..... 399/119
5,953,562 A 9/1999 Kawaguchi et al. ..... 399/117
6,002,896 A 12/1999 Miyamoto et al. ..... 399/114
6,029,031 A 2/2000 Yokomori et al. ..... 399/109
6,055,406 A 4/2000 Kawai et al. ..... 399/360
6,061,538 A 5/2000 Arimitsu et al. ..... 399/111
6,064,843 A 5/2000 Isobe et al. ..... 399/111
6,072,969 A 6/2000 Yokomori et al. ..... 399/199
6,173,140 B1 * 1/2001 Suzuki et al. ..... 399/113
6,236,821 B1 * 5/2001 Yokoyama et al. ..... 399/113

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A process cartridge detachably mountable to the main assembly of an electrophotographic image forming apparatus, the process cartridge includes a first frame; a second frame connected with the first frame for rotation about a shaft; an electrophotographic photosensitive drum provided in the first frame; a developing member, provided in the second frame, for developing an electrostatic latent image formed on the photosensitive drum with a developer; and a development driving force receiving member for receiving a driving force for rotating the developing member from a main assembly of the apparatus when the process cartridge is mounted to the main assembly of the apparatus, the development driving force receiving member being disposed coaxial with the shaft.

21 Claims, 17 Drawing Sheets

PROCESS CARTRIDGE AND IMAGE FORMING APPARATUS

FIELD OF THE INVENTION AND RELATED ART

The present invention relates to a process cartridge and an electrophotographic image forming apparatus for forming an image on the recording material, to which the process cartridge is detachably mountable.

Here, the electrophotographic image forming apparatus is an apparatus which forms an image on a recording material through an electrophotographic process. The electrophotographic image forming apparatus may be an electrophotographic copying machine, an electrophotographic printer (a LED printer, a laser beam printer or the like), an electrophotographic printer type facsimile machine, an electrophotographic printer type word processor or the like.

The process cartridge is a cartridge containing as a unit an electrophotographic photosensitive drum and a charge member, a developing member or a cleaning member, the unit being detachably mountable to the main assembly of the image forming apparatus. The process cartridge is a cartridge containing as a unit an electrophotographic photosensitive drum and at least one of a charge member, a developing member and a cleaning member, the unit being detachably mountable to the main assembly of the image forming apparatus. The process cartridge may contain as a unit an electrophotographic photosensitive drum and at least a developing member, the unit being detachably mountable to a main assembly of the electrophotographic image forming apparatus.

In an electrophotographic image forming apparatus using the electrophotographic image forming process, use has been made of the process cartridge type in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type, the maintenance operation can be carried out in effect by the users without the necessity of relying on serviceman, and therefore, the operativity is improved. Therefore, the process cartridge type is widely used in the field of electrophotographic image forming apparatus.

Such a process cartridge has the following structure to maintain a proper positional relation between the photosensitive drum and the developing roller to provide stabilized image quality.

The cleaning unit having the photosensitive drum and the developing unit having the developing device are coupled rotatably by a pin, and the photosensitive drum and the developing roller are pressed to each other by a pressing spring. Here, the developing roller is provided with rotatable rollers. By this, there is distance between the axes of the photosensitive drum and the developing roller. Here, the diameter of the rollers is larger than the diameter of the developing roller, and by the press-contact between the photosensitive drum and rollers by the spring force of the pressing spring, the gap is maintained between the photosensitive drum and the developing roller.

FIG. 19 illustrates an example of a driving training for the process cartridge 103. The driving force is transmitted to the process cartridge 103 by the driving gear 153 and the drum gear 4. The driving gear 5 is in meshing engagement with the drum gear 4, and the driving force is transmitted through the drum gear 4. The driving gear 5 drives the developing roller and also transmits the driving force to the toner stirring gear 8 through idler gears 6, 7.

A description will be provided as to the positioning of the process cartridge 103 relative to the main assembly of the apparatus. As shown in FIG. 20, a longitudinal end of a process cartridge 103 is provided with an engaging portion 40 for engagement with a guide portion 160 provided in the main assembly of the apparatus. By doing so, when the process cartridge 103 is inserted into the main assembly of apparatus, the engaging portion 40 is inserted along the guide portion 160, and the correct positioning is accomplished by abutment to the stopper 161 provided in the main assembly of the apparatus. At this time, the drum gear 4 of a process cartridge 103 is brought into engagement with a driving gear 153 provided in the main assembly of the apparatus.

When the driving force is applied to the process cartridge 103, an engagement force F1 is produced in a direction deviated by an engaging pressure angle from a normal line L1 on a line connecting the centers of rotation of the drum driving gear 4 and the driving gear 153 at a pitch point. By this, the process cartridge 103 is pressed against the stopper 161 of the main assembly of the apparatus. Thus, the force is produced substantially perpendicularly to the axial direction of the photosensitive drum 1, and the positional deviation of the cartridge 103 can be suppressed.

However, with this structure, as shown in FIG. 19, when the cartridge 103 is driven, the driving force for the developing unit 152 is concentrated in the direction E of engagement between the drum gear 4 and the driving gear 5. Therefore, as seen in the longitudinal direction of the process cartridge 103, a twisting force is produced. In order to avoid deformation of the frame due to such a force so as to stabilize the image quality, it is conventional that the frame of a process cartridge 103 is reinforced, or the spring forces of the left and right pressing springs are made different from each other. By doing so, a balance is provided against the twisting of the frame. The above-described structure is very good and effective to avoid the deformation of the frame, thus stabilizing the image quality.

SUMMARY OF THE INVENTION

The present invention provides a further development of the above described structure.

Accordingly, it is a principal object of the present invention to provide a downsized and light weight process cartridge and an electrophotographic image forming apparatus to which the process cartridge is detachably mountable.

It is another object of the present invention to provide a process cartridge in which the deformation of the frame thereof is effectively prevented despite the fact that thickness of the frame is reduced in order to reduce the size and weight of the process cartridge, and to provide an electrophotographic image forming apparatus to which the process cartridge is detachably mountable.

It is a further object of the present invention to provide a process cartridge in which when the driving force is applied from the main assembly of apparatus to the process cartridge, the moment about the center of the frame provided by the engaging force of the gears can be suppressed, to provide and an image forming apparatus to which the process cartridge is detachably mountable.

According to an aspect of the present invention, that is provided a process cartridge detachably mountable to the main assembly of an electrophotographic image forming apparatus, the process cartridge comprising a first frame; a second frame connected with the first frame for rotation about a shaft; an electrophotographic photosensitive drum provided in the first frame; a developing member, provided in the second frame, for developing an electrostatic latent image formed on the photosensitive drum with a developer; and a development driving force receiving member for receiving a driving force for rotating the developing member from a main assembly of the apparatus when the process cartridge is mounted to the main assembly of the apparatus, the development driving force receiving member being disposed coaxial with the shaft.

These and other objects, features and advantages of the present invention will become more apparent upon a consideration of the following description of the preferred embodiments of the present invention taken in conjunction with the accompanying drawings.

According to another aspect of the present invention, there is provided an image forming apparatus to which the process cartridge is detachably mountable.

DESCRIPTION OF THE PREFERRED EMBODIMENTS

The preferred embodiments of the present invention will be described.

Embodiment 1

In the following description, "lateral direction" is the direction in which the process cartridge is mounted to or demounted from the main assembly of apparatus. The longitudinal direction of the process cartridge is the direction crossing with (substantially perpendicular to) the lateral direction. The "upper surface" of the process cartridge is the surface which is in an upper position when the process cartridge is mounted to the main assembly of the apparatus, and the "lower surface" is a surface which is in a lower position when the process cartridge is mounted to the main assembly of the apparatus.

(Electrophotographic image forming apparatus)

Figure 1:
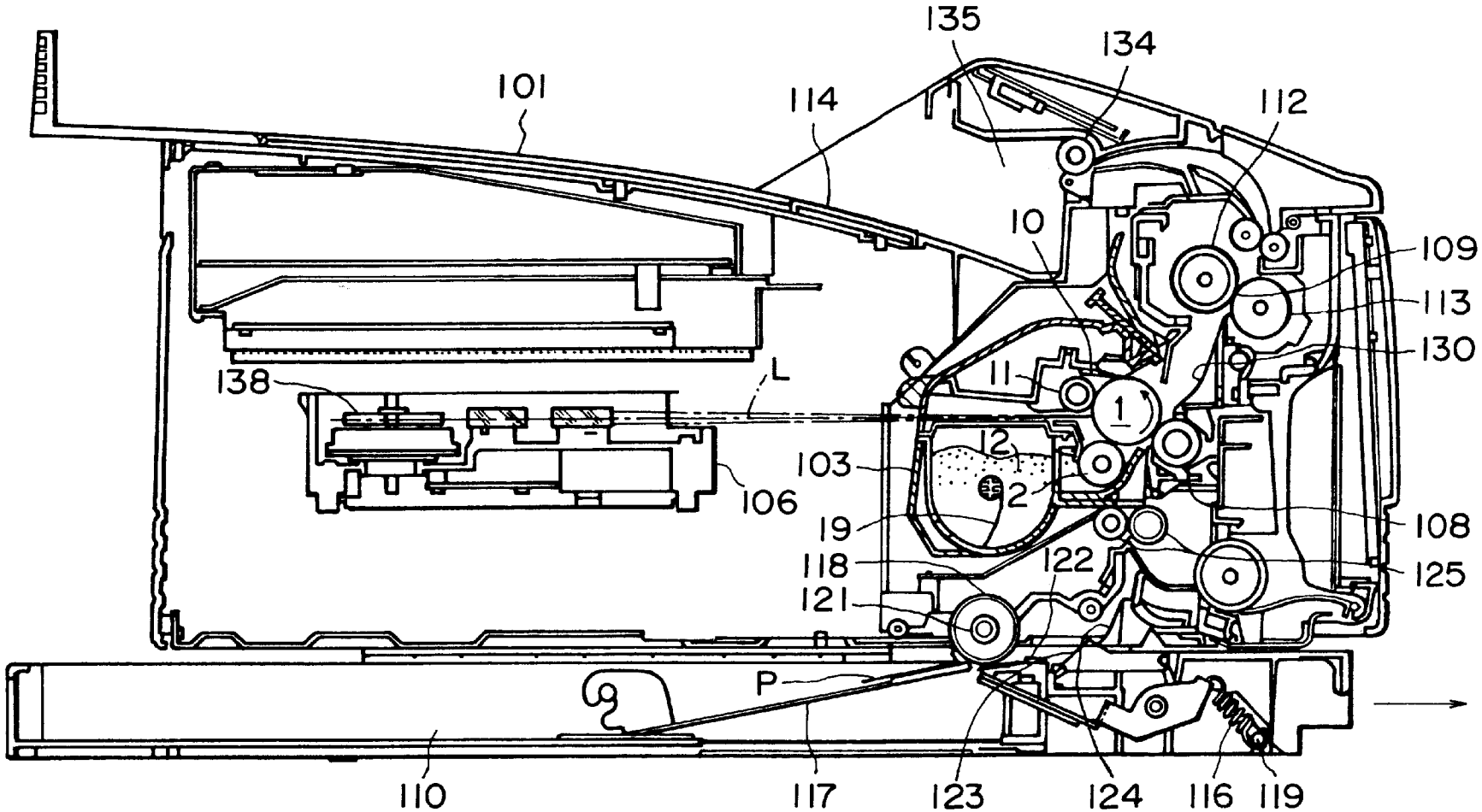
FIG. 1 is a longitudinal sectional view of the process cartridge which is mounted in the main assembly of the image forming apparatus.
Figure 2:
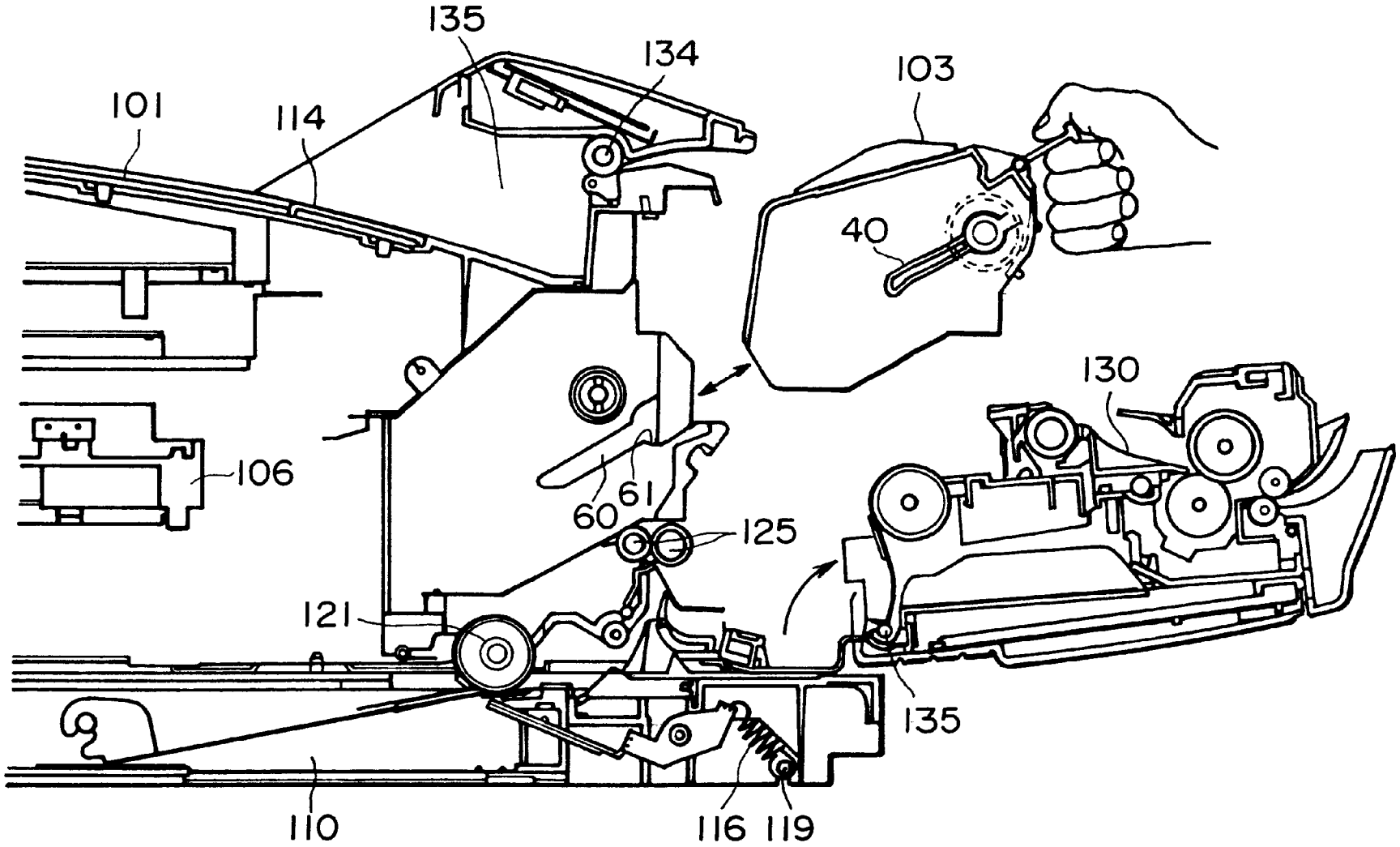
FIG. 2 is a longitudinal sectional view illustrating mounting and demounting of the process cartridge relative to the main assembly of the image forming apparatus.

An exemplary image forming apparatus 101 shown in FIGS. 1 and 2 is a laser beam printer: electrophotographic type.

FIG. 1 is a side view of the apparatus 101, and FIG. 2 is a side view illustrating mounting-and-demounting operation of the process cartridge.

First, a description will be provided as to the structure of the feeding means for the recording material (recording paper, OHP sheet or the like).

A plurality of recording materials P are contained in a feeding cassette 110, and the leading ends of the recording materials P are pressed against a surface of a feeding roller 118 by a stacking plate 117 urged by a feeding spring 116. The feeding cassette 110 can be pulled out in the rightward direction in FIG. 1 to permit the user to load the recording material into the image forming apparatus. At this time, the shaft 119 moves upwardly along slide grooves (unshown) formed in side walls of the feeding cassette 110. Therefore, the stacking plate 117 lowers to the bottom surface of the feeding cassette 110 to permit the loading of the recording material P.

The feeding roller 118 is fixed on the shaft 121. To an end of the shaft 121, a solenoid (unshown) is provided to permit rotation drive control of the feeding roller 118. At the end of the recording material P adjacent to feeding roller side, there is provided a separation claw 122. Adjacent the end, a cassette inlet guide 123 is rotatably mounted by a spring (unshown). The main assembly base of the apparatus is provided with a guide portion 124 at a lateral side to guide the recording material P to registration rollers 125.

In response to a feeding start signal, a solenoid (unshown) is activated so that driving force of the driving gear is transmitted to the shaft 121 through the clutch. By this, the feeding roller 118 is rotated to feed the recording material P to the cassette inlet guide 123. At this time, only the topmost recording material P is picked up due to the relation in the friction coefficient. Thereafter, the recording material P reaches a nip between registration rollers 125 by rotation of the feeding roller 118. The recording material P is fed by the registration rollers 125 to between the photosensitive drum 1 and the transfer roller 108 in synchronism with a leading-edge of the developed image on the photosensitive drum 1.

Thereafter, the developed image formed on the photosensitive drum 1 through the image forming process is transferred onto the recording material P by a transfer roller 108 which is press-contacted to the photosensitive drum 1 at a predetermined pressure.

The recording material P having received the developed image is fed to fixing means 109 along a fixing inlet guide 130. The recording material P is passed through a nip formed between the heated fixing roller 112 and the pressing roller 113, so that the developed image image is fixed on the recording material P. Then, the recording material P is discharged to a discharging tray 114 provided at the discharging outlet 135 by discharging rollers 134.

A description will be provided as to a scanner unit 106, namely a laser optical system.

The laser beam scans the surface of the photosensitive drum 1 in a direction of a generating line thereof by rotation of a polygonal mirror 138. By turning of the scanner unit 106 ON-OFF, the potential of the photosensitive drum 1 is changed to a predetermined level at a point exposed to the laser beam. By doing so, an electrostatic latent image is formed on the photosensitive drum 1.

The cartridge 103 is mounted or demounted relative to the main assembly 101 of apparatus in a direction crossing with the longitudinal direction (axial direction) of the photosensitive drum 1.

At each of the opposite longitudinal end surfaces of the process cartridge 103, there is provided a guide portion 40 for engagement with the guide portion 60 provided in the main assembly 101 of the apparatus. By the provision thereof, when the process cartridge 103 is inserted into the main assembly 101 of the apparatus, the guide portion 40 is inserted along the guide portion 60. When they are abutted to stoppers 61 of the main assembly 101 of the apparatus, the process cartridge 103 is correctly positioned. At this time, the gear 18 of the cartridge 103 and the main assembly gear 154 of the main assembly 101 apparatus are brought into meshing engagement with each other.

(Process cartridge)

A description will be provided as to the process cartridge 103 and the major parts related with the present invention.

(Cleaning unit)

Figure 3:
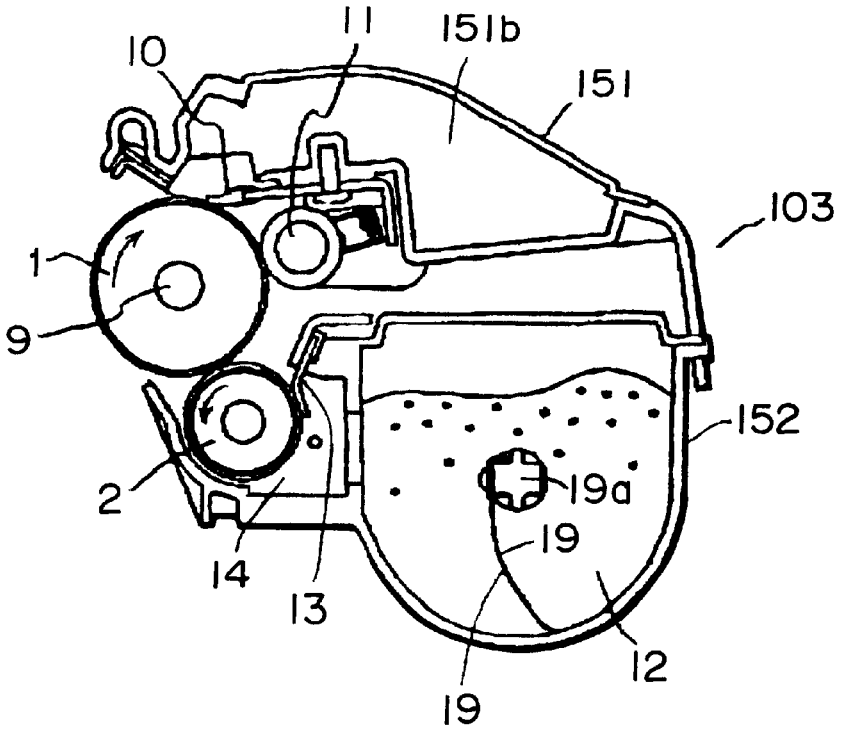
FIG. 3 is a longitudinal sectional view of the process cartridge according to an embodiment of the present invention.

FIG. 3 shows a process cartridge according to an embodiment of the present invention. Designated by 151 is a first frame (cleaning unit). The first frame 151 is provided with a photosensitive drum 1 mounted thereto on the shaft 9 for rotation. The first frame 151 is provided with a cleaning member 10 in the form of a cleaning blade for removing residual toner from the photosensitive drum 1 and a charging roller 11 for uniformly charging the surface of the photosensitive drum 1. In each of the side surfaces of the frame, there is provided a connecting hole (unshown) full connection with a second frame 152 (developing unit) which will be described hereinafter.

(Developing unit)

In FIG. 3, designated by 152 is a second frame (developing unit). The second frame 152 has a developer accommodating portion 12, a developing member 2 in the form of a developing roller (developer carrying member) and a developing blade 13. In the second frame 152, the developer is fed on the developer accommodating portion 12 into the developing container 14 by a stirring member 19. The developing blade 13 is press-contacted to the outer periphery of the developing member 2 which is rotated in the counterclockwise direction, so that a thin layer of the developer is formed with the developer being electrically charged. The stirring member 19 includes a shaft 19*a* rotatably mounted to the second frame 152 and stirring blades 19*b* in the form of elastic sheets, and the stirring member 19 is rotated in the clockwise direction.

Figure 4:
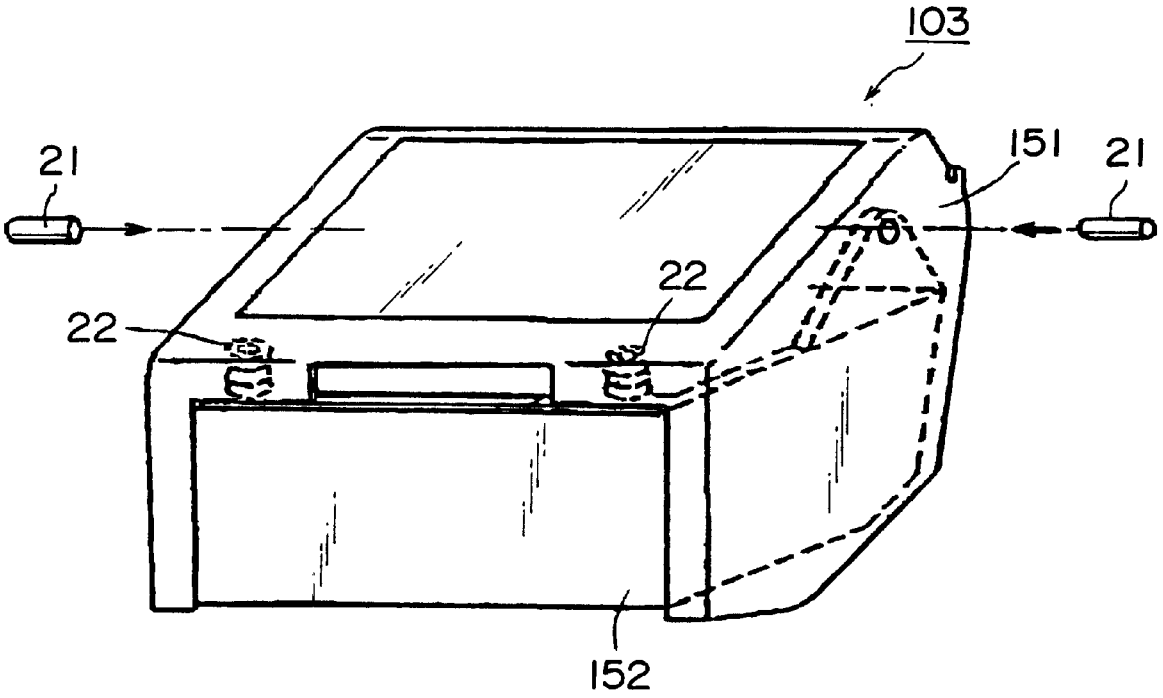
FIG. 4 is a perspective view as seen from the backside of the process cartridge.
Figure 5:
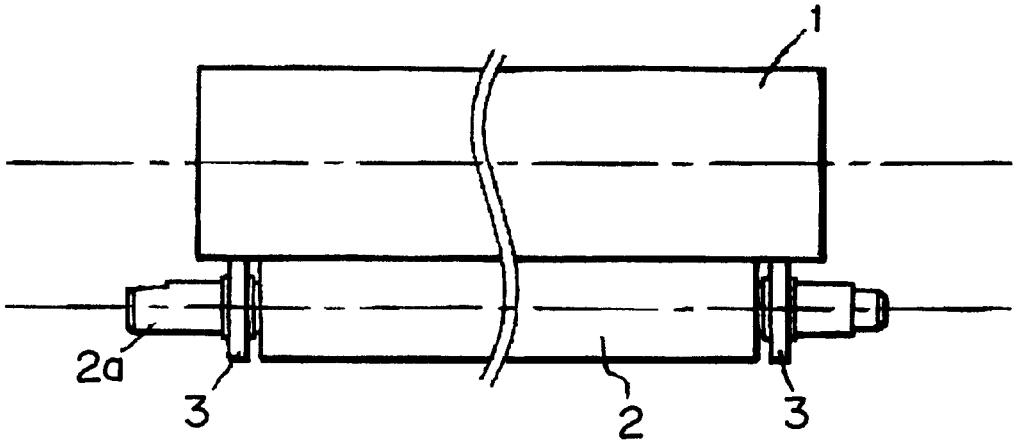
FIG. 5 illustrates the relationship between a photosensitive drum and a developing roller.

As shown in FIG. 4, the first frame (cleaning unit) 151 having a photosensitive drum and the second frame (developing unit) 152 having the developing device are rotatably coupled by a shaft 21 (connecting member), and the photosensitive drum 1 and the developing member 2 are pressed against each other by pressing springs (compression springs) 22. As shown in FIG. 5, the developing member 2 is provided with a rotatable roller 3 on a shaft 2*a*. By doing so, there is a distance between the axes of the photosensitive drum 1 and the developing member 2. The diameter of the roller 3 is larger than the diameter of the developing member 2. By the elastic force of the spring 22, the photosensitive drum 1 and the roller 3 are press-contacted to each other so that a predetermined gap is maintained between the photosensitive drum 1 and the developing member 2.

(Driving train)

Figure 6:
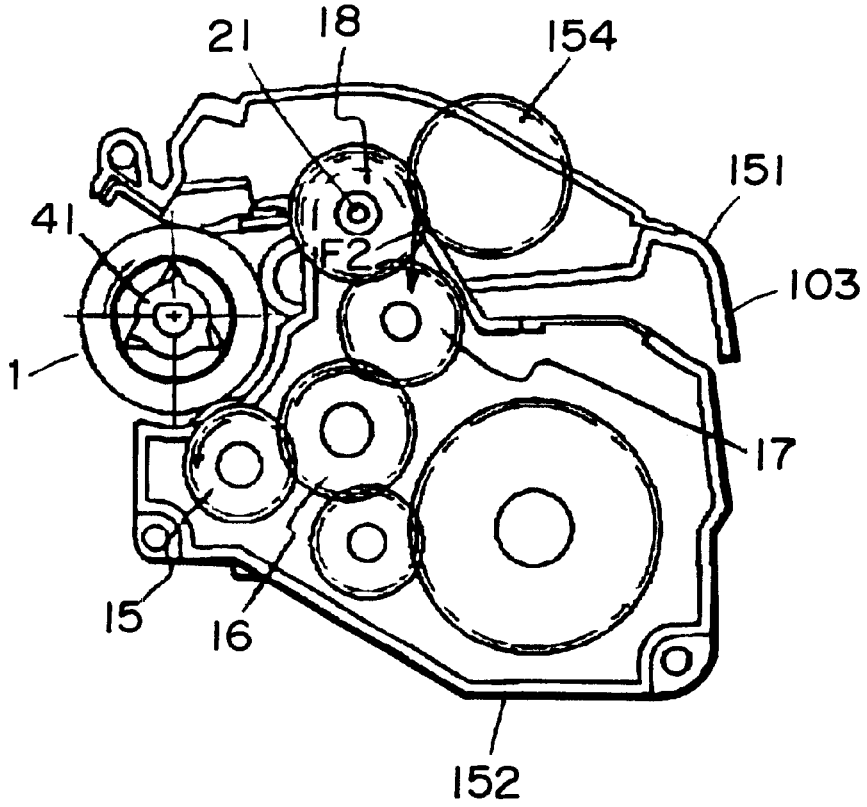
FIG. 6 is a side view of a process cartridge according to an embodiment of the present invention.

FIG. 6 shows a driving train of the process cartridge 103.

The cartridge 103 of this embodiment is supplied with a driving force from the main assembly 101 of the apparatus at the first frame 151 and the second frame 152. The second frame 152 is provided with a gear train including a gear 15 provided at the end of the developing member 2, and idler gears 16, 17 operatively associated with a development driving force receiving member 18. The main assembly 101 of the apparatus is provided with a main assembly development driving force receiving member 154 engageable with the development driving force receiving member 18. When the process cartridge 103 is inserted into the main assembly 101 of the apparatus, the driving force is transmittable. Here, development driving force receiving member 18 is a driving force inputting member of the second frame 152.

The rotation shaft of the photosensitive drum 1 is provided with a drum driving force receiving member 41 driving the first frame 151 to permit integral rotation with the photosensitive drum 1.

The main assembly 101 of the apparatus is provided with a main assembly coupling (unshown) engageable with the drum driving force receiving member 41 (male-female engagement). When the process cartridge 103 is inserted into the main assembly 101 of apparatus, they are engaged to permit drive transmission in the axial direction of the photosensitive drum 1. The drum driving force receiving member 41 functions as a driving force inputting member of the first frame 151.

(connection between the cleaning unit and the developing unit)

Here, a description will be provided as to the connecting member 20 provided in the second frame 152.

Figure 7:
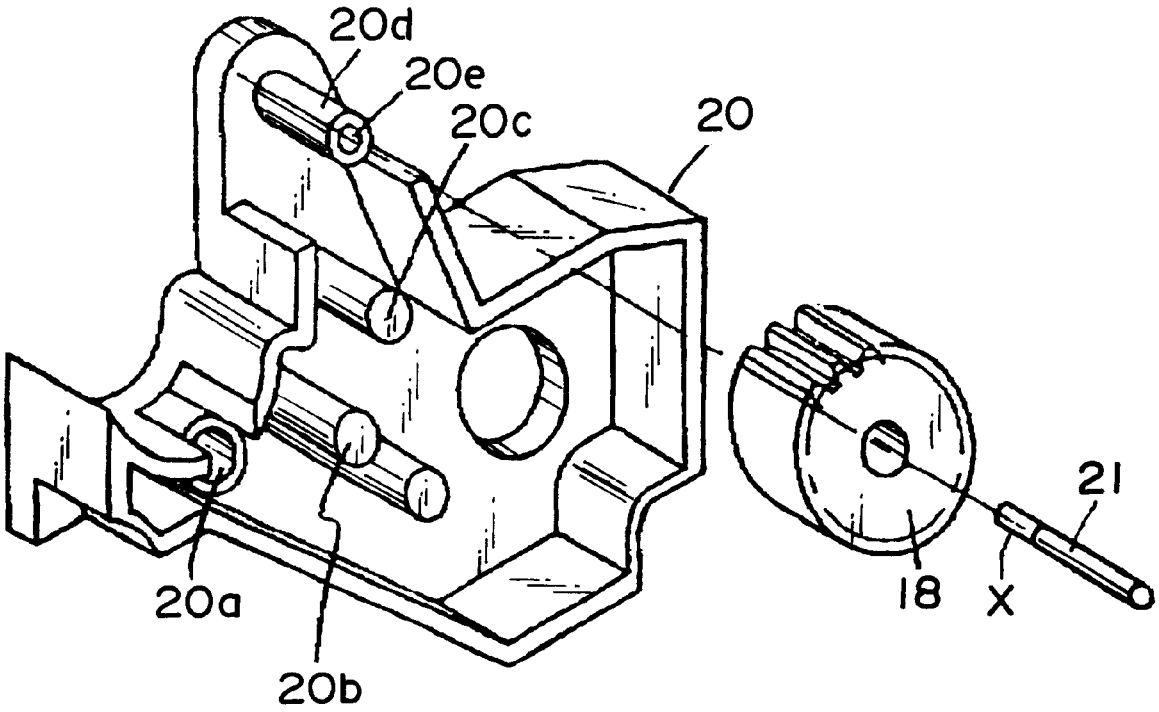
FIG. 7 is an exploded perspective view of the process cartridge.
Figure 8:
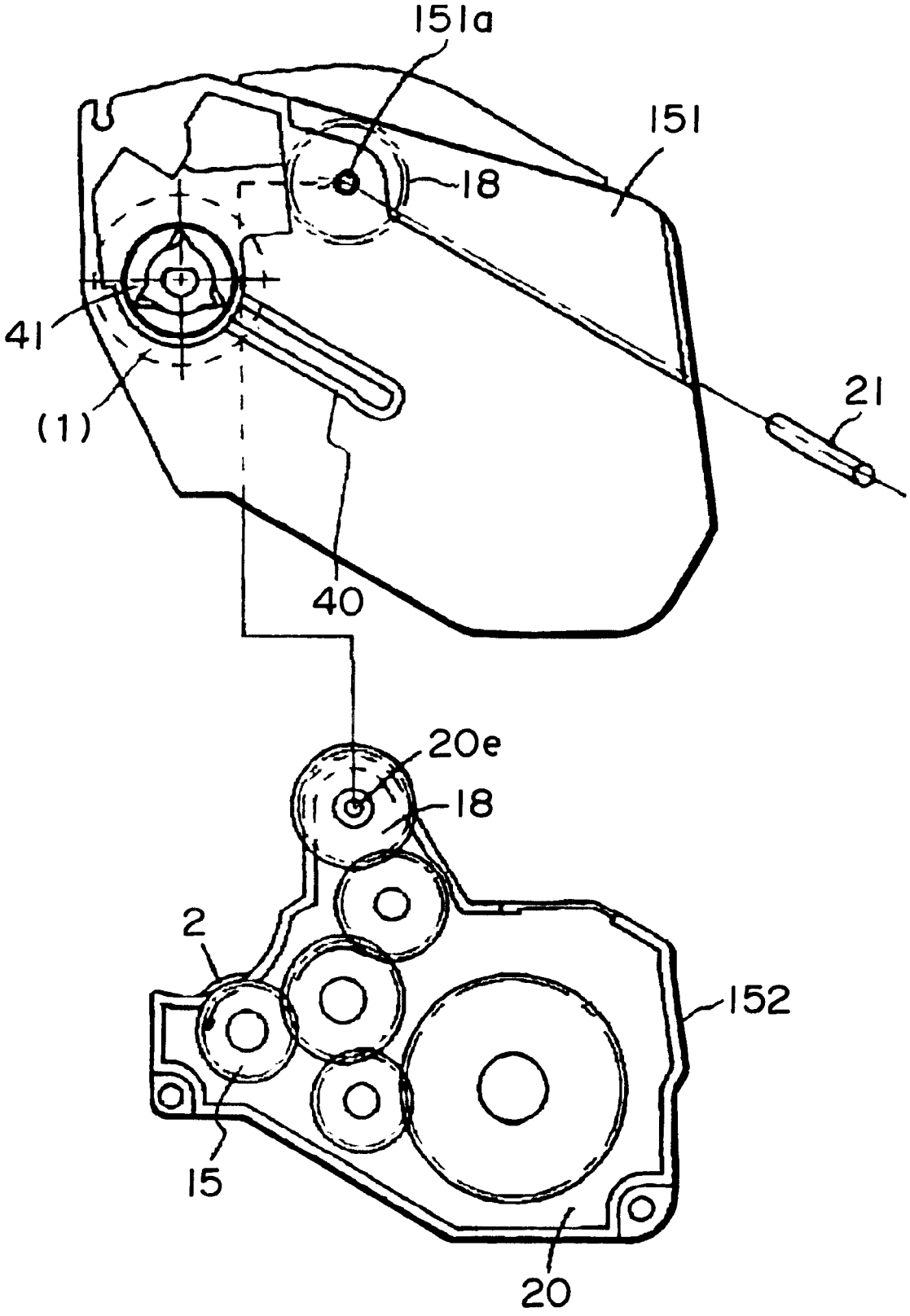
FIG. 8 is an exploded perspective view of the process cartridge according to an embodiment of the present invention.

FIG. 7 shows a connecting member 20 at a driving side where the driving train of the second frame 152 is provided. The driving side connecting member 20 is provided with a bearing portion 20*a* for the developing member 2, shafts 20*b*, 20*c* for idler gears 16 and 17 and a shaft 20*d* for the development driving force receiving member 18. There is provided a through-hole 20*e* for connection with the first frame 151 at the center of the shaft 20*d* of the connecting member 20.

On the other hand, the connecting member (unshown) at the non-driving side which is opposite from the driving side, is provided with a through-hole for connection with the first frame 151 and a bearing portion for the developing member 2. The bearing portion for the developing member 2 at the opposite side has a center on an extension of a centerline of the bearing portion 20*a*. The through-hole 20*e* (unshown) for the connection at the opposite side is on the same center line of the through-hole 20C.

The connecting members at the driving side and the non-driving side are correctly positioned relative to the developing container 14 by a positioning boss (unshown) affixed to the developing container 14.

The connection between the first frame 151 and the second frame 152, as shown in the figure, is accomplished by the through-hole 20*e* of the connecting member 20 fixed to the second frame 152, a hole 151*a* provided at the lateral sides of the first frame 151 and the shaft 21. More particularly, the first frame 151 is engaged with the second frame 152 so that hole 151*a* is aligned with the through-hole 20*e*, and the shaft 21 is penetrated through the hole 151*a* and the through-hole 20C.

By doing so, the first frame 151 and the second frame 152 are coupled for swing movement about the shaft 21. The center of the development driving force receiving member 18 is disposed at the connecting position (the center of the sing movement) of the units.

Between the first frame 151 and the second frame 152, there is provided a pressing spring 22 at each of the one and the other longitudinal ends of the frames. By this, the photosensitive drum 1 and the developing member 2 are pressed to each other. The position of the pressing spring 22 is disposed across the center of the development driving force receiving member 18 from the photosensitive drum 1 and the developing member 2. In this embodiment, the pressing spring 22 is a compression coil spring. The spring forces of the pressing springs 22 at the opposite longitudinal ends are substantially equal.

Figure 9:
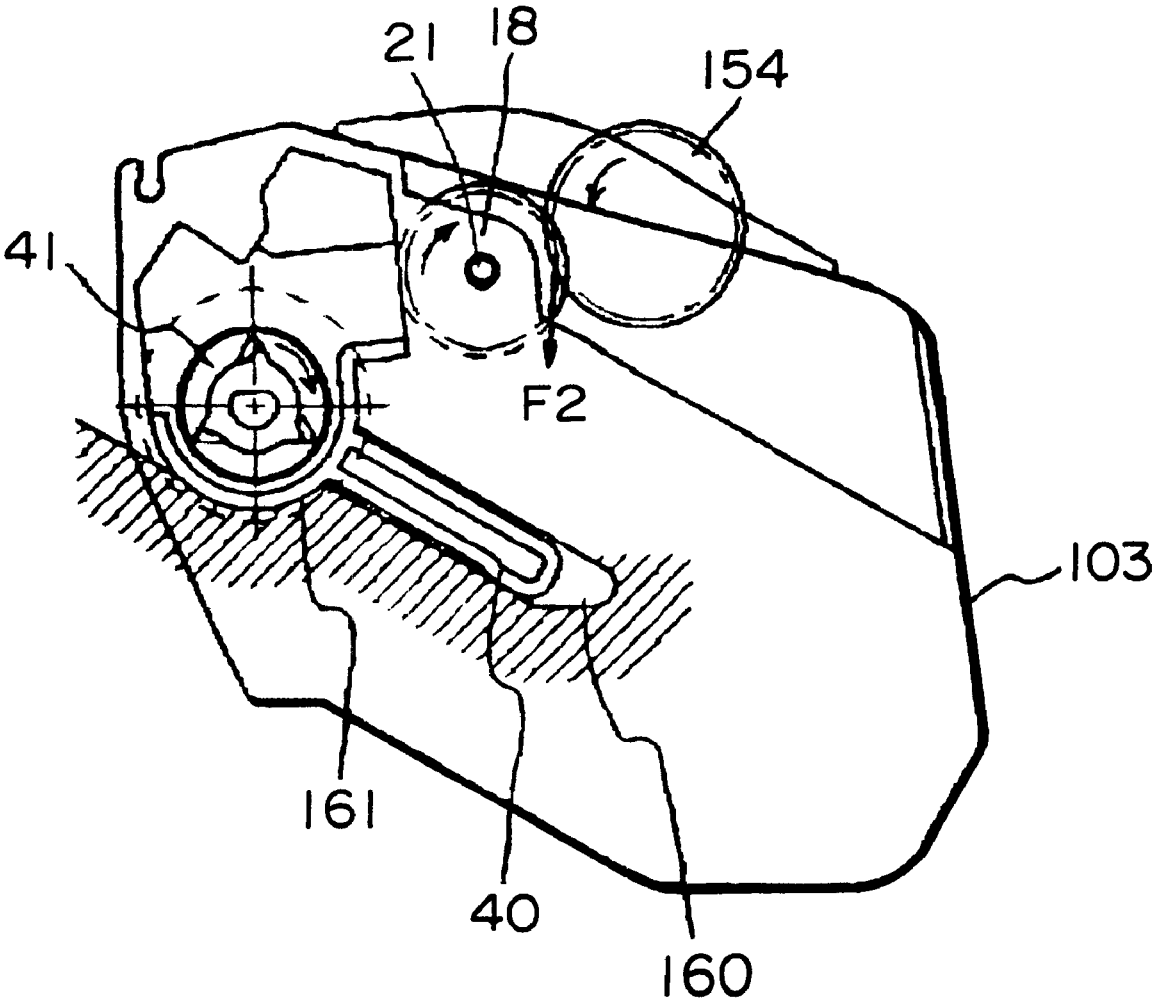
FIG. 9 is a side view illustrating positioning of the process cartridge according to the embodiment of the present invention.

With the structure, as shown in FIG. 9, when the driving force is supplied from the main assembly 101 of the apparatus to the process cartridge 103, the engagement force as produced in the prior art between the first frame 151 and the second frame 152 is not produced. On the other hand, the process cartridge 103 is pressed to the main assembly 101 of the apparatus by the engagement force F2 between the main assembly 101 driving force input gear, that is, the main assembly gear 154 and the development driving force receiving member 18, so that the relative position therebetween is maintained.

At that time, the driving force is transmitted to the first frame 151 through the cartridge drum driving force receiving member 41 in the direction of the axis of the photosensitive drum 1, and the pressing against the main assembly 101 of apparatus using the engagement force F2 is not disturbed.

The above-described embodiments are summarized as follows.

1. A process cartridge detachably mountable to the main assembly 101 of an electrophotographic image forming apparatus, the process cartridge 103 comprising:

a first frame 151;

a second frame 152 connected with the first frame 151 for rotation about a shaft 21;

an electrophotographic photosensitive drum 1 provided in the first frame 151;

a developing member 2, provided in the second frame 152, for developing an electrostatic latent image formed on the photosensitive drum 1 with a developer; and a development driving force receiving member 18 for receiving a driving force for rotating the developing member 2 from a main assembly 101 of the apparatus when the process cartridge 103 is mounted to the main assembly 101 of the apparatus, the development driving force receiving member 18 being disposed coaxial with the shaft 21.

2. A process cartridge according to Item 1, wherein the development driving force receiving member 18 receives the driving force in a direction substantially perpendicular to a longitudinal direction of the developing member 2 in the form of a developing roller 2.

3. A process cartridge according to Item 2, wherein the development driving force receiving member 18 includes a gear which is engageable with a main assembly gear 154 provided in the main assembly 101 of apparatus at a position downstream of a center of the gear of the process cartridge 103 with respect to a mounting direction in which the process cartridge 103 dismounted to the main assembly 101 of apparatus.

4. A process cartridge according to Item 3, wherein the gear is provided in the second frame 152 and is exposed to the outside through an opening 155 provided in the first frame 151 so as to be engageable with the main assembly gear 154.

5. A process cartridge according to Item 3, wherein the gear of the process cartridge 103 and the main assembly gear 154 are helical gears 18.

6. A process cartridge according to Item 1, further comprising a drum driving force receiving member 41 for receiving a driving force for rotating the photosensitive drum from the main assembly 101 of the apparatus when the process cartridge 103 is mounted to the main assembly 101 of the apparatus, the drum driving force receiving member 41 receiving a driving force in a direction crossing with a direction in which the development driving force receiving member 18 receives the driving force from the main assembly 101 of the apparatus when the drum driving force receiving member 41 receives the driving force from the main assembly 101 of the apparatus.

7. A process cartridge according to Item 6, wherein the drum driving force receiving member 41 is in the form of a coupling.

8. A process cartridge according to Item 1, wherein the development driving force receiving member 18 is in the form of a gear, and wherein the gear is disposed outside the second frame 152 at one longitudinal end of the developing member 2 in the form of a developing roller 2.

9. A process cartridge according to Item 8, wherein the driving force received by a gear is transmitted to the developing roller 2 by a first gear train 17, 16, 15 and is transmitted to a removed developer feeding member through a second gear train to rotate the feeding member, and wherein the feeding member functions to feed the developer removed from the photosensitive drum by a cleaning member 10.

10. A process cartridge according to Item 9, wherein the second gear train transmits the driving force to a stirring member 19 provided in a developer accommodating portion 12 accommodating a developer to be used for development.

11. A process cartridge according to Item 1, wherein the development driving force receiving member 18 is disposed downstream of the drum driving force receiving member 41 with respect to a mounting direction in which the process cartridge 103 is mounted to the main assembly 101 of the apparatus, wherein the development driving force receiving member 18 and the drum driving force receiving member 41 are provided at the same side with respect to a direction crossing with the mounting direction, and wherein the process cartridge 103 is mounted to the main assembly 101 of the apparatus in a direction crossing with an axial direction of the photosensitive drum.

12. A process cartridge according to Item 11, wherein the drum driving force receiving member 41 is in the form of a coupling, and wherein the development driving force receiving member 18 is in the form of a helical gear 18, and the helical gear 18 is disposed inside the coupling with respect to a direction crossing with the mounting direction.

13. A process cartridge according to Item 11, wherein the development driving force receiving member 18 is disposed downstream of the drum driving force receiving member 41, and the photosensitive drum, the developing member 2 in the form of a developing roller 2, a crank for driving the removed developer feeding member are disposed in the order named from an upstream side toward a downstream side with respect to the mounting direction, and wherein the feeding member functions to feed the developer removed from the photosensitive drum by a cleaning member 10.

14. A process cartridge according to Item 13, wherein the first frame 151 includes a developer accommodating portion 12 accommodating the developer to be used for development, and wherein there is provided a removed developer accommodating portion for accommodating a removed developer removed from the photosensitive drum by a cleaning member 10 at a position above the developer accommodating portion 12 when the process cartridge 103 is mounted to the main assembly 101 of the apparatus, and the feeding member is disposed in the removed developer accommodating portion.

15. A process cartridge according to Item 6, wherein the drum driving force receiving member 41 is in the form of a coupling and is engageable with a main assembly coupling provided in the main assembly 101 of apparatus in a longitudinal direction of the photosensitive drum to receive a driving force for rotating the photosensitive drum.

16. A process cartridge according to Item 7 or 15, wherein the coupling is a form of a twisted substantially triangular prism, and the main assembly coupling is a twisted hole having a substantially triangular cross-section, and wherein the substantially triangular prism and the hole are engaged to transmit the driving force.

17. A process cartridge detachably mountable to the main assembly 101 of an electrophotographic image forming apparatus, the process cartridge 103 comprising:

a first frame 151 disposed such that it takes an upper position when the process cartridge 103 is mounted to the main assembly 101 of the apparatus;

a second frame 152 connected with the first frame 151 for rotation about a shaft 21;

an electrophotographic photosensitive drum provided in the first frame 151;

a developing roller 2, provided in the second frame 152, for developing an electrostatic latent image formed on the photosensitive drum with a developer, the second frame 152 being disposed such that it takes a lower position when the process cartridge 103 is mounted to the main assembly 101 of the apparatus;

a developer accommodating portion 12 provided in the second frame 152 and accommodating the developer;

a cleaning member 10, provided in the second frame 152, for removing the developer remaining on the photosensitive drum;

a removed developer accommodating portion 151*b*, provided in the first frame 151, for accommodating the developer removed by the cleaning member 10, wherein the removed developer accommodating portion 151*b* is disposed such that it is above the developer accommodating portion 12 when the process cartridge 103 is mounted to the main assembly 101 of the apparatus;

a coupling, provided in the first frame 151, for receiving from the main assembly 101 of apparatus a driving force for rotating the photosensitive drum when the process cartridge 103 is mounted to the main assembly 101 of the apparatus, the coupling being coaxial with the photosensitive drum; and a helical gear 18, provided in the second frame 152, for receiving a driving force for rotating the developing member 2 from the main assembly 101 of the apparatus when the process cartridge 103 is mounted to the main assembly 101 of the apparatus, wherein the helical gear 18 is disposed downstream of the coupling in a mounting direction in which the process cartridge 103 is mounted to the main assembly 101 of apparatus, and the helical gear 18 is disposed coaxial with the shaft 21, and is disposed inside the coupling in the direction crossing with the mounting direction;

wherein the photosensitive drum and the developing roller 2 are disposed in the order named from an upstream side toward a downstream side in the mounting direction, and wherein the helical gear 18 and the coupling are disposed at the same and in the direction crossing with the mounting direction, and the process cartridge 103 is mounted to the main assembly 101 of the apparatus in a direction crossing with an axial direction of the photosensitive drum.

18. A process cartridge according to Item 17, wherein the coupling is a form of a twisted substantially triangular prism, and the main assembly coupling is a twisted hole having a substantially triangular cross-section, and wherein the substantially triangular prism and the hole are engaged to transmit the driving force.

19. A process cartridge according to Item 14 or 17, wherein the developer accommodating portion 12 accommodates the developer.

20. An electrophotographic image forming apparatus for forming an image on the recording material, to which a process cartridge 103 is detachably mountable, the apparatus comprising:

(a) a main assembly development driving force transmitting member 154;

(b) a mounting portion for detachably mounting a process cartridge 103, the process cartridge 103 including:

a first frame 151;

a second frame 152 connected with the first frame 151 for rotation about a shaft 21;

an electrophotographic photosensitive drum provided in the first frame 151;

a developing member 2, provided in the second frame 152, for developing an electrostatic latent image formed on the photosensitive drum with a developer; and a development driving force receiving member 18 for receiving a driving force for rotating the developing member 2 from a main assembly 101 of the apparatus when the process cartridge 103 is mounted to the main assembly 101 of the apparatus, the development driving force receiving member 18 being disposed coaxial with the shaft 21.

21. An electrophotographic image forming apparatus for forming an image on the recording material, to which a process cartridge 103 is detachably mountable, the apparatus comprising:

(a) a main assembly coupling;

(b) a main assembly helical gear 154; and (c) a mounting portion for detachably mounting a process cartridge 103, the process cartridge 103 including;

a first frame 151 disposed such that it takes an upper position when the process cartridge 103 is mounted to the main assembly 101 of the apparatus;

a second frame 152 connected with the first frame 151 for rotation about a shaft 21;

an electrophotographic photosensitive drum provided in the first frame 151;

a developing roller 2, provided in the second frame 152, for developing an electrostatic latent image formed on the photosensitive drum with a developer, the second frame 152 being disposed such that it takes a lower position when the process cartridge 103 is mounted to the main assembly 101 of the apparatus;

a developer accommodating portion 12 provided in the second frame 152 and accommodating the developer;

a cleaning member 10, provided in the second frame 152, for removing the developer remaining on the photosensitive drum;

a removed developer accommodating portion 151*b*, provided in the first frame 151, for accommodating the developer removed by the cleaning member 10, wherein the removed developer accommodating portion 151*b* is disposed such that it is above the developer accommodating portion 12 when the process cartridge 103 is mounted to the main assembly 101 of the apparatus;

a coupling, provided in the first frame 151, for receiving from the main assembly 101 of apparatus a driving force for rotating the photosensitive drum when the process cartridge 103 is mounted to the main assembly 101 of the apparatus, the coupling being coaxial with the photosensitive drum; and a helical gear 18, provided in the second frame 152, for receiving a driving force for rotating the developing member 2 from the main assembly 101 of the apparatus when the process cartridge 103 is mounted to the main assembly 101 of the apparatus, wherein the helical gear 18 is disposed downstream of the coupling in a mounting direction in which the process cartridge 103 is mounted to the main assembly 101 of apparatus, and the helical gear 18 is disposed coaxial with the shaft 21, and is disposed inside the coupling in the direction crossing with the mounting direction;

wherein the photosensitive drum and the developing roller 2 are disposed in the order named from an upstream side toward a downstream side in the mounting direction, and wherein the helical gear 18 and the coupling are disposed at the same and in the direction crossing with the mounting direction, and the process cartridge 103 is mounted to the main assembly 101 of the apparatus in a direction crossing with an axial direction of the photosensitive drum.

Figure 10:
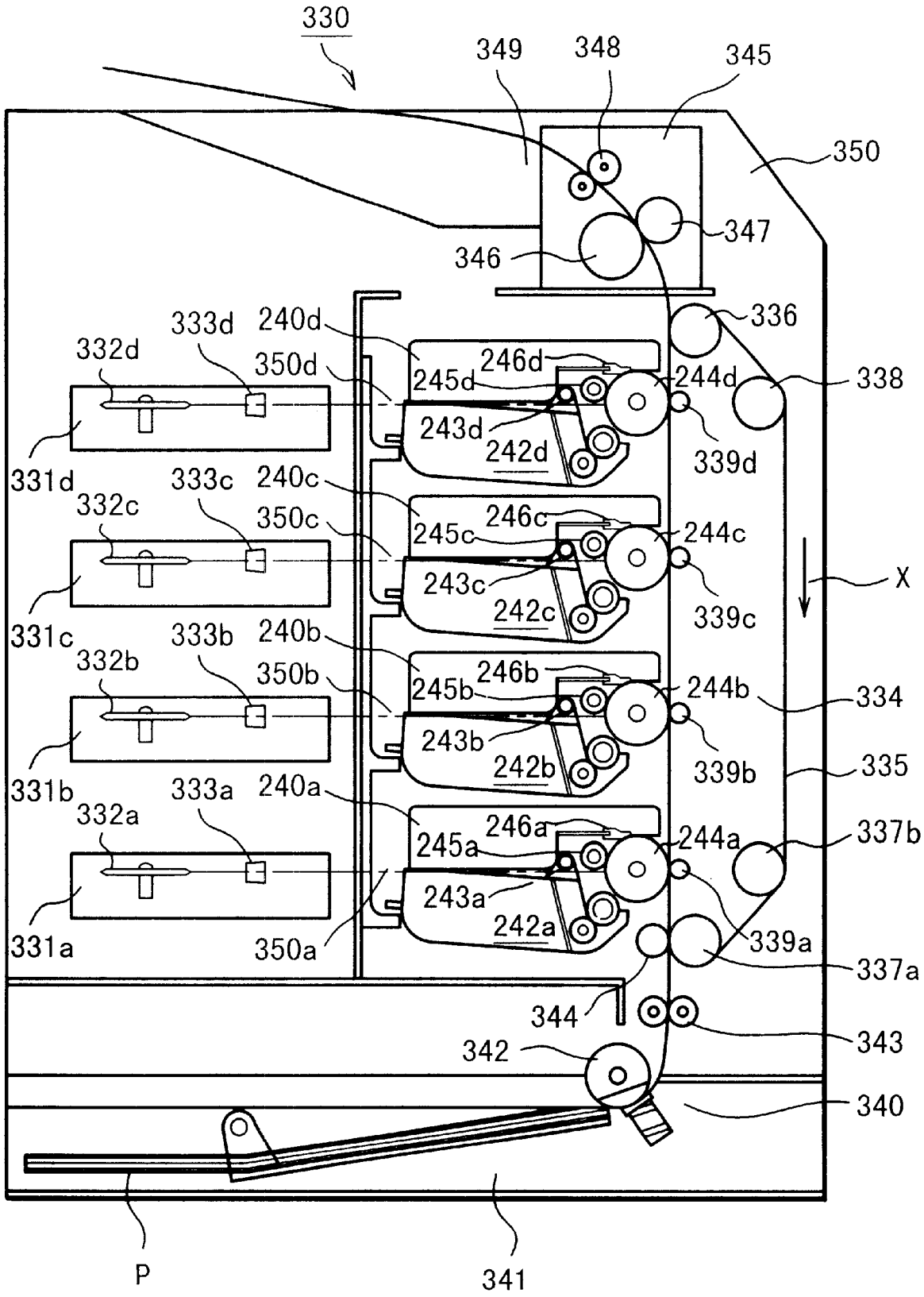
FIG. 10 is a general arrangement of an electrophotographic image forming apparatus according to an embodiment of the present invention.
Figure 11:
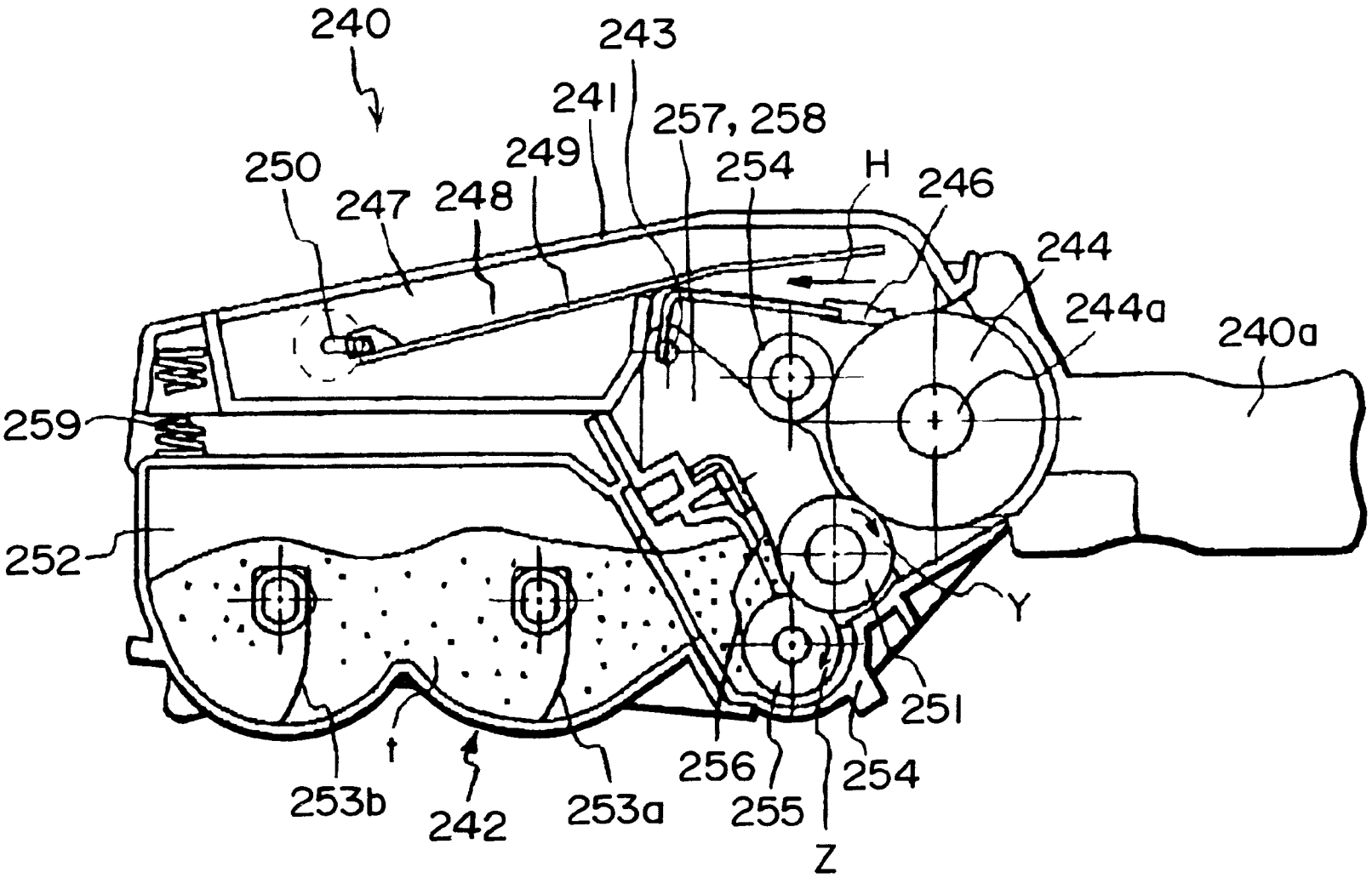
FIG. 11 is a sectional view of a process cartridge according to an embodiment of the present invention.
Figure 12:
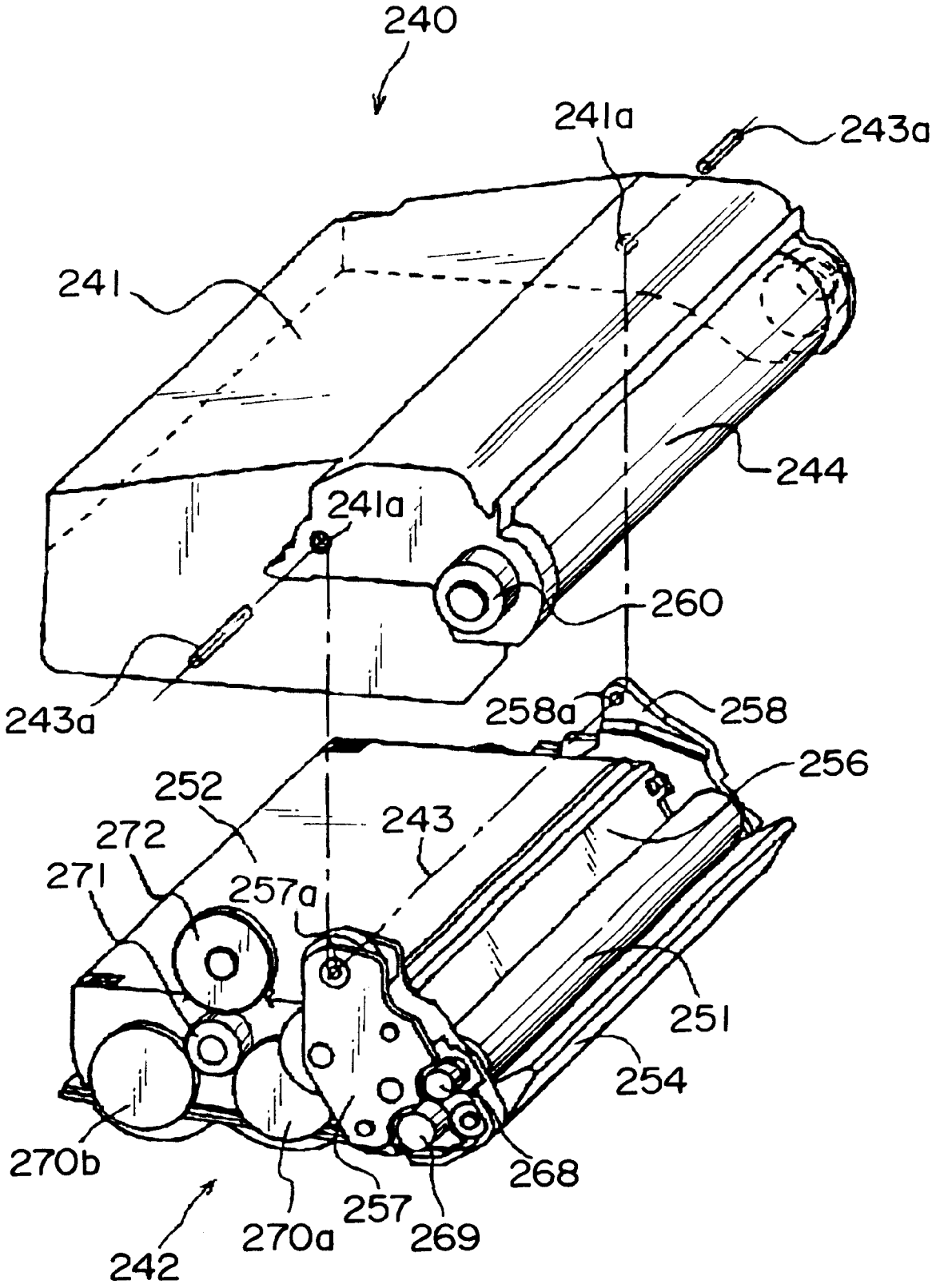
FIG. 12 is an exploded perspective view of a process cartridge.
Figure 13:
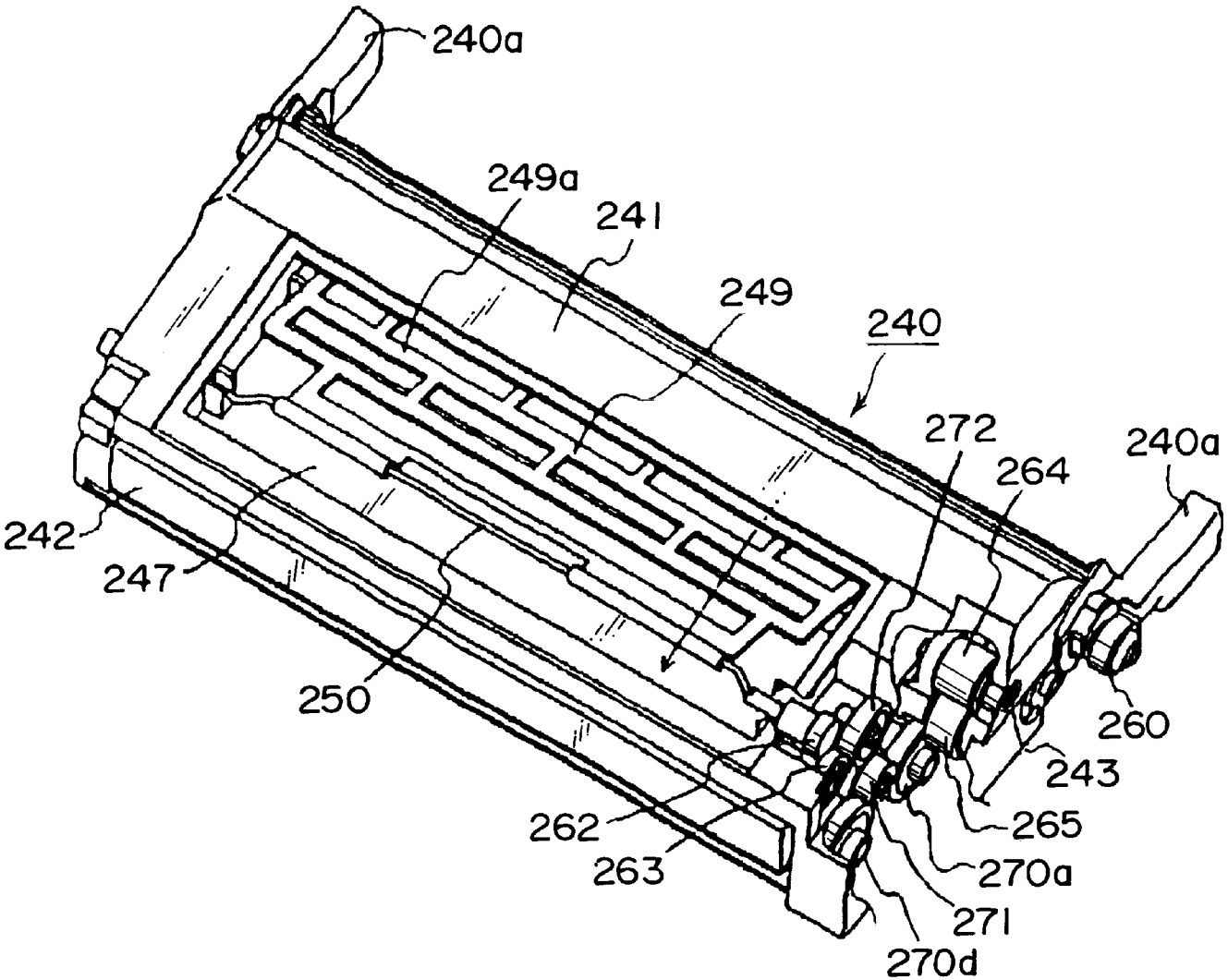
FIG. 13 is a perspective view of a process cartridge as seen from the bottom thereof.
Figure 14:
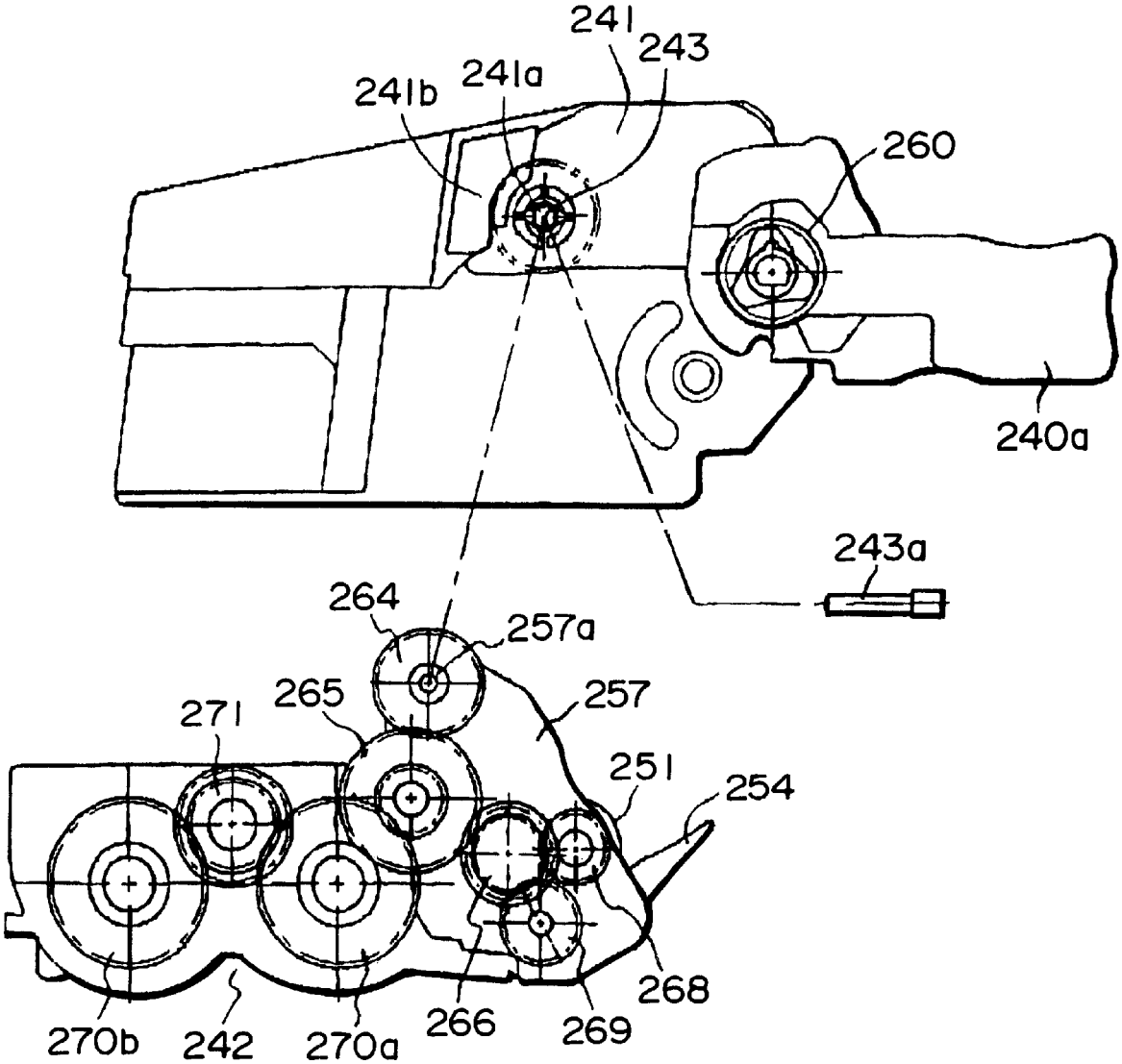
FIG. 14 illustrates connection between a first frame and a second frame.
Figure 15:
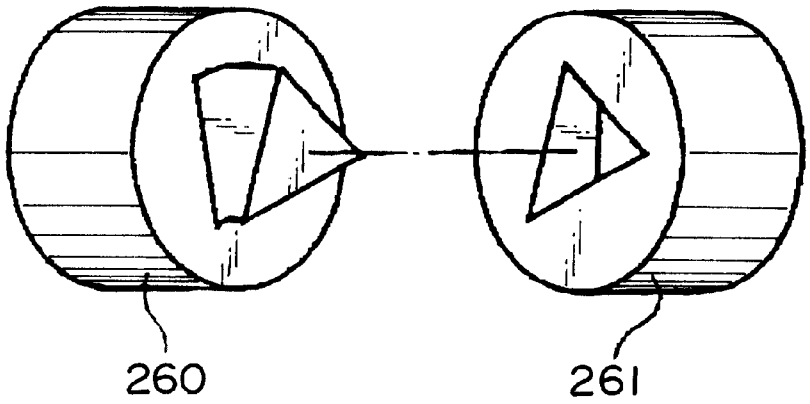
FIG. 15 illustrates a drum driving force transmitting member and a main assembly drum driving force transmitting member.
Figure 16:
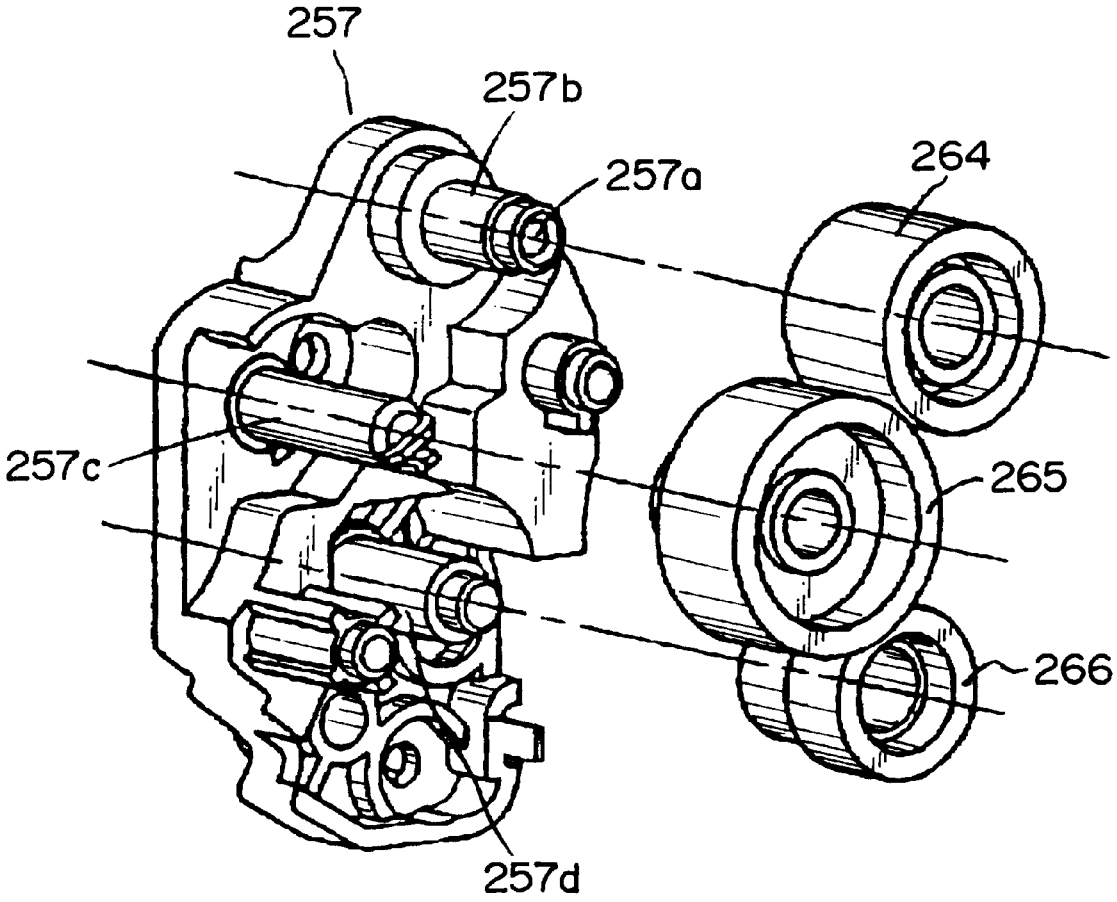
FIG. 16 illustrates a connecting member for a drive transmission mechanism of a developing unit.
Figure 17:
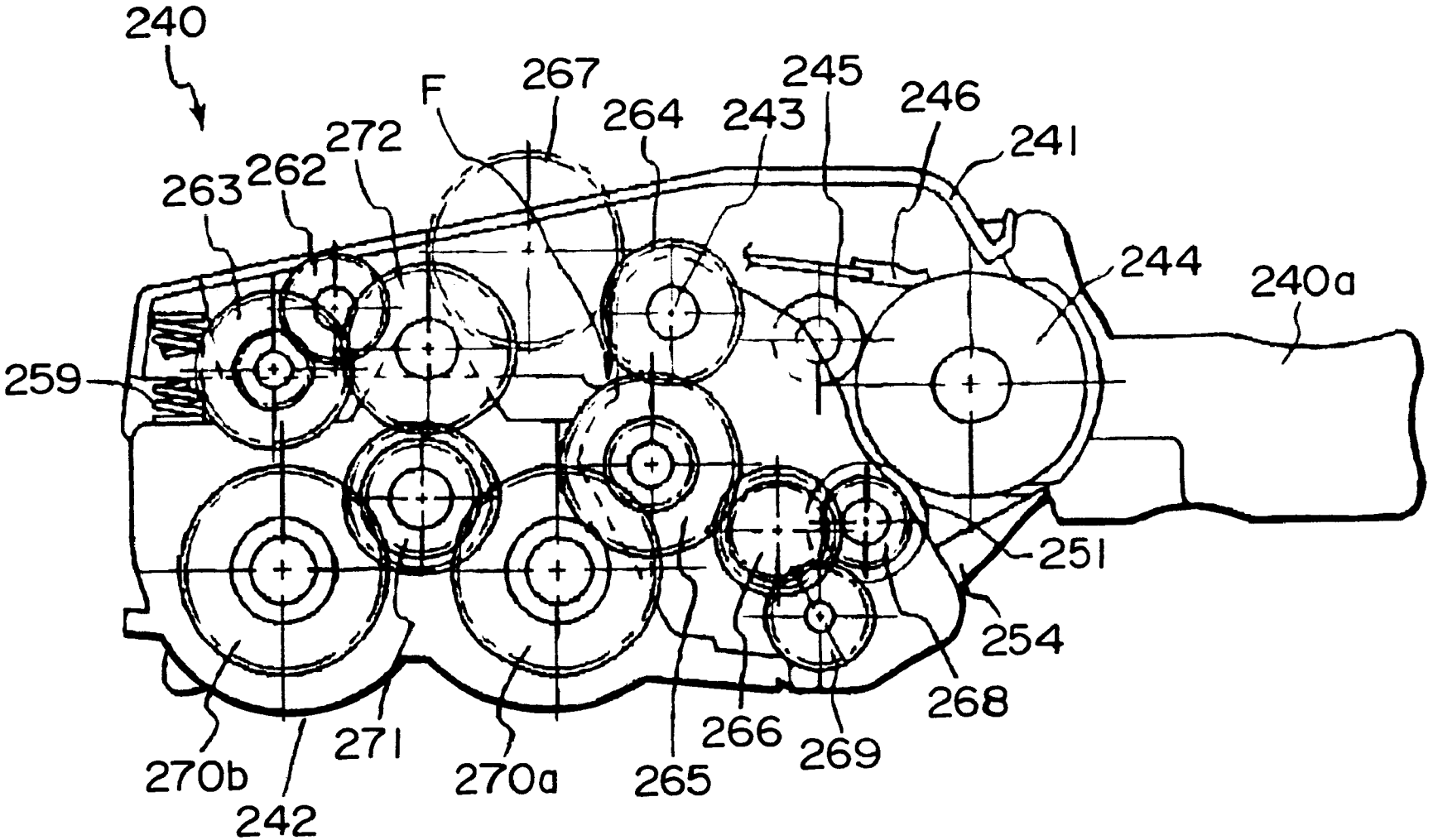
FIG. 17 illustrates a drive transmission mechanism for the process cartridge.
Figure 18:
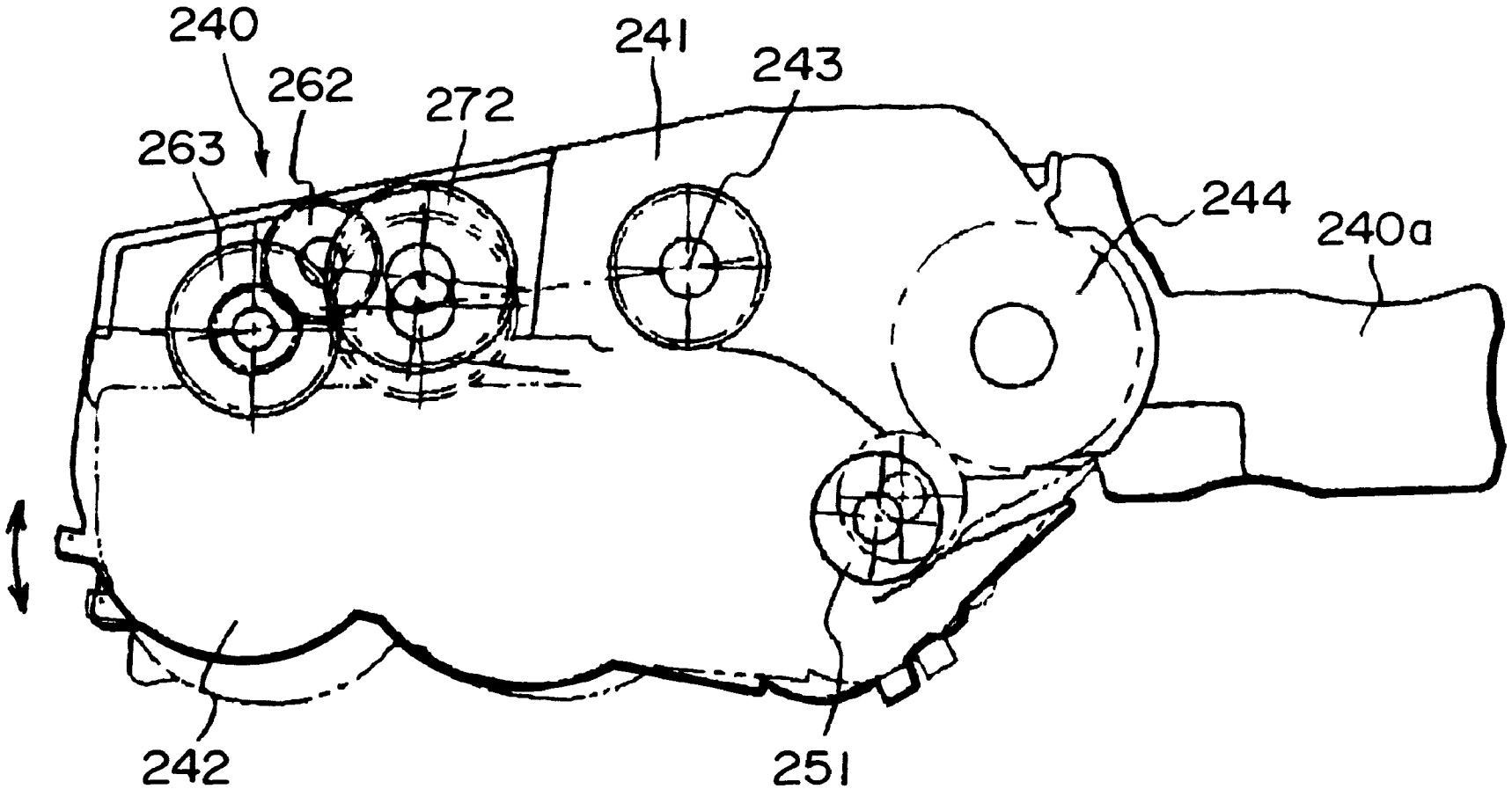
FIG. 18 illustrates a drive transmission mechanism when the first frame swings.
Figure 19:
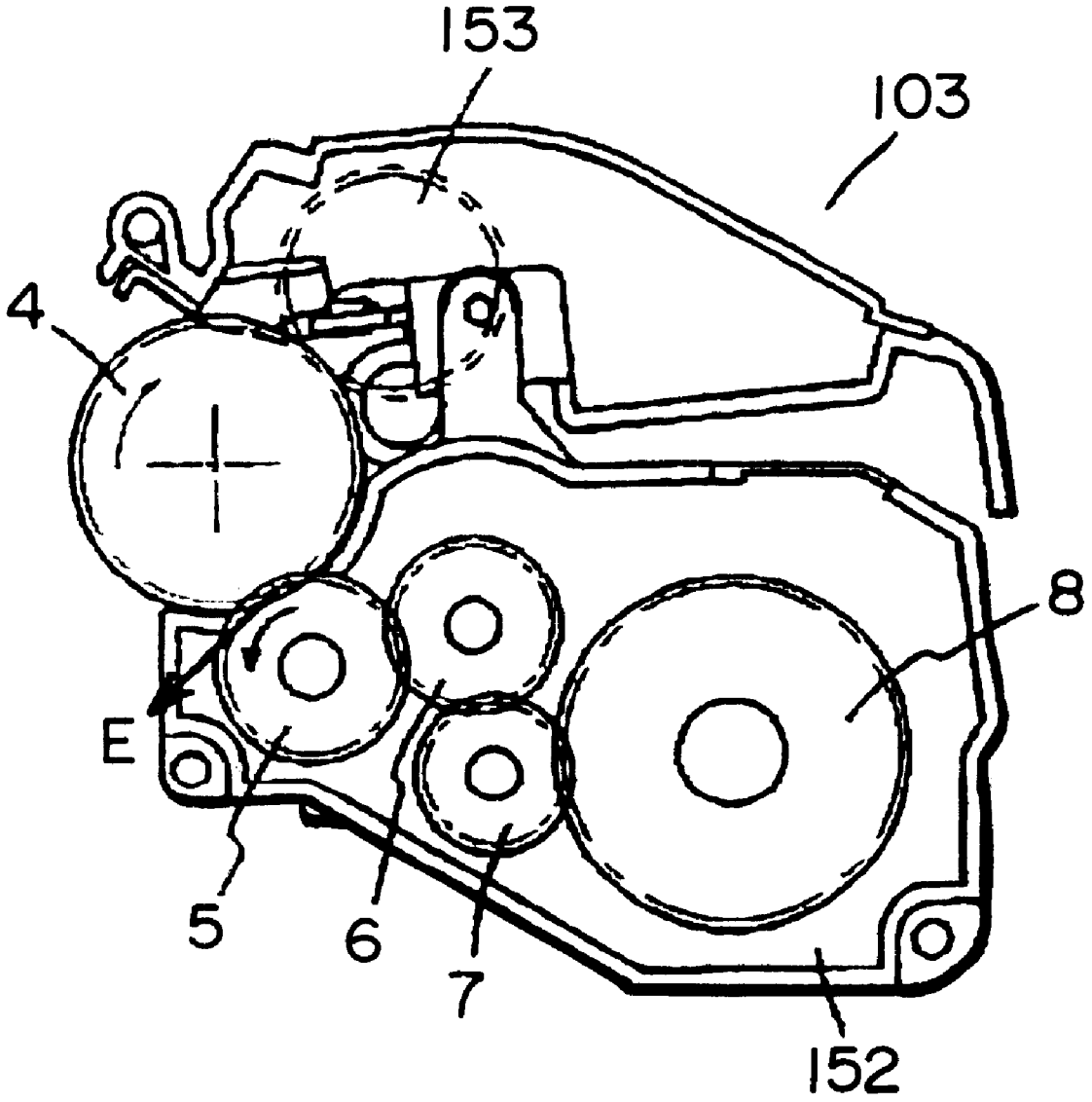
FIG. 19 PRIOR ART
FIG. 19 is a longitudinal sectional view of a conventional process cartridge.
Figure 20:
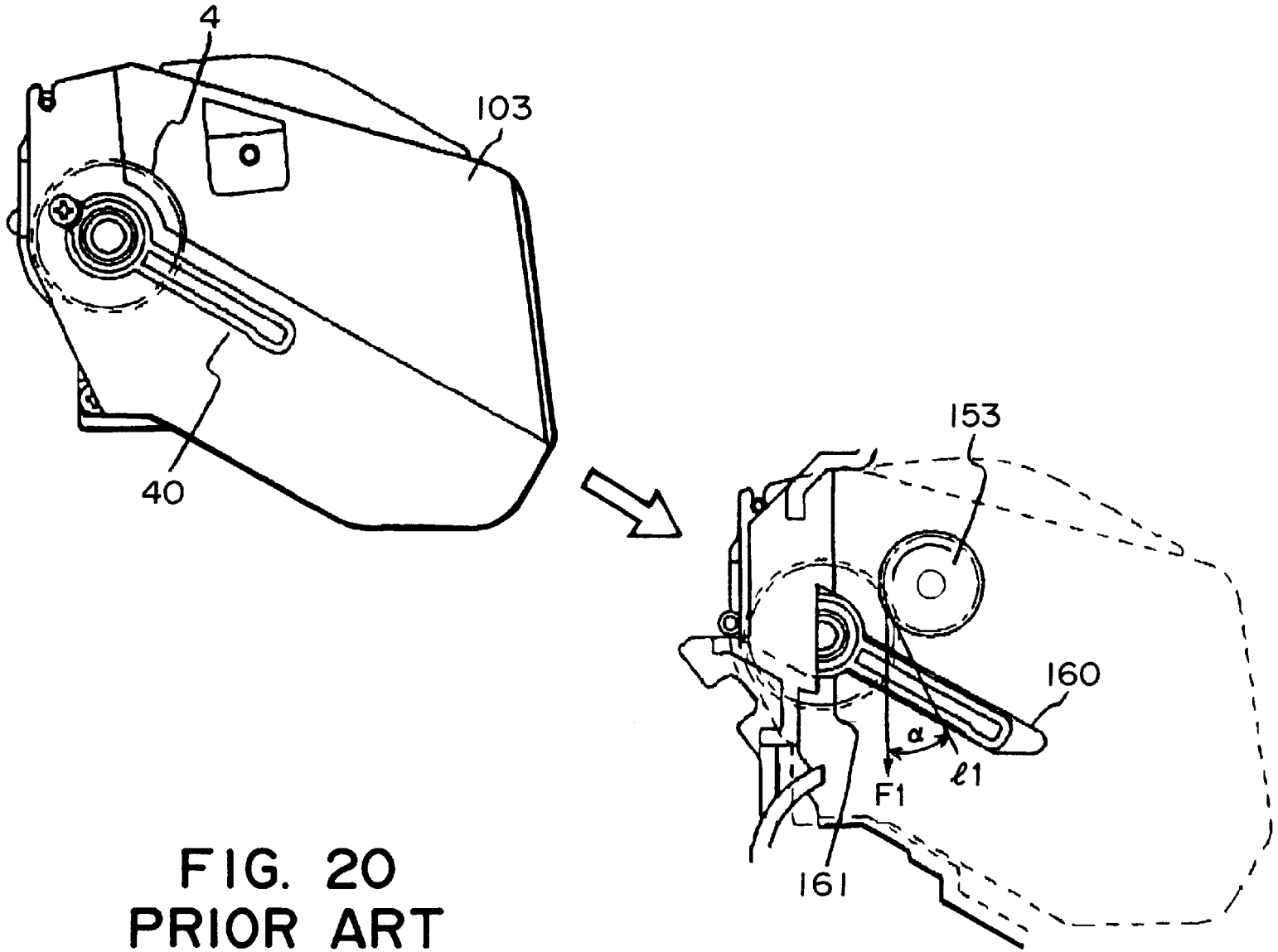
FIG. 20 PRIOR ART
FIG. 20 is a side view illustrating positioning of a conventional process cartridge.

The process cartridge and electrophotographic image forming apparatus in this third embodiment of the present invention will be described with reference to the appended drawings. FIG. 10 is a drawing for showing the general structure of the electrophotographic image forming apparatus in this embodiment, and FIG. 11 is a sectional view of the process cartridge in this embodiment. FIG. 12 is a perspective view of the partially disassembled process cartridge in this embodiment, and FIG. 13 is a perspective view of the process cartridge as seen from above, with the walls of the removed developer storing portion and driving force transmission mechanism partially removed. FIG. 14 is a drawing for showing how the first and second frame portions are joined, and FIG. 15 is a drawing for showing the drum driving force transmitting portion on the cartridge side and the drum driving force transmitting portion on the apparatus main assembly side. FIG. 16 is a drawing for showing the connecting member of the driving force transmitting mechanism of the development unit, and FIG. 17 is a drawing for showing the driving force transmitting mechanism on the process cartridge side. FIG. 18 is a drawing for showing the reaction of the driving force transmitting mechanism on the process cartridge side when the first frame portion pivots.

(Electrophotographic image forming apparatus)

First, referring to FIG. 10, the overall structure of the electrophotographic image forming apparatus will be described. The image forming apparatus 330 illustrated in FIG. 10 is a full-color laser beam printer which employs an electrophotographic image forming method. In the main assembly 350 of this image forming apparatus 330, four cartridge spaces 350*a*–350*d* are provided, being aligned in the vertical direction, into which cartridges 240 are removably installed. All the cartridges 240 placed in their own cartridge spaces are exactly the same in structure, but are different in the color of the developer t stored therein. More specifically, the cartridge space 350*a* holds a cartridge 240*a* in which developer t of cyan color is stored; the cartridge space 350*b* holds a cartridge 240*b* in which developer t of yellow color is stored; the cartridge space 350*c* holds a cartridge 240*c* in which developer t of magenta color is stored; and the cartridge space 350*d* holds a cartridge 240*d* in which developer t of black color is stored.

With the four process cartridges 240*a*–240*d* properly placed in the main assembly 350 of the image forming apparatus 330, four photosensitive drums 244*a*–244*d* align in the vertical direction. Photosensitive drums 244 are rotated in the counterclockwise direction in the drawing. Adjacent to the peripheral surfaces of the photosensitive drums 244*a*–244*d*, charge rollers 245*a*–245*d* for uniformly charging the peripheral surfaces of the photosensitive drums 244*a*–244*d*, development unit 242*a*–242*d* for developing an electrostatic latent image; an electrostatic transferring apparatus 334 for transferring the developer image on each photosensitive drum 244 onto a recording medium P, and cleaning members 246*a*–246*d* for removing the developer remaining on the photosensitive drums 244*a*–244*d*, are disposed, correspondingly, in the listed order in terms of the rotational directions of the photosensitive drums 244*a*–244*d*.

Referential codes 331*a*–331*d* designate scanner units which form an electrostatic latent image on the corresponding photosensitive drums 244*a*–244*d* by projecting a laser beam onto the peripheral surface of the corresponding photosensitive drums 244*a*–244*d*, while modulating the laser beam according to image information.

Each cartridge 240 integrally comprises the photosensitive drum 244, the charge roller 245, the development unit 242, and the cleaning member 246. The cartridge 240 will be described later in detail.

The photosensitive drum 244 comprises an aluminum cylinder, for example, with a diameter of 230 mm, and a layer of organic, photoconductive material (OPC based photosensitive drum) coated on the peripheral surface of the aluminum cylinder. The photosensitive drum 244 is rotatably supported, at its longitudinal ends, by supporting members. As a driving force is transmitted to one of the longitudinal ends of the photosensitive drum 244 from a driving motor (unillustrated), the photosensitive drum 244 rotates in the counterclockwise direction in the drawing.

The charge roller 245 is an elastic roller and is of a contact type. In other words, as charge bias is applied to the charge roller 245, with the charge roller 245 placed in contact with the peripheral surface of the photosensitive drum 244, the peripheral surface of the photosensitive drum 245 is uniformly charged.

The scanner units 331*a*–331*d* are positioned at about the same levels as the corresponding photosensitive drums 244*a*–244*d*. Beams of light modulated with image signals are projected from laser diodes (unillustrated) upon polygon mirrors 332*a*–332*d*, which are being rotated at a high speed. The beams of the image forming light, or the beams of light modulated with image signals, are reflected by the polygon mirrors 332*a*–332*d*, and are focused upon the peripheral surfaces of the photosensitive drum 244*a*–244*d* through focusing lenses 333*a*–333*d*, selectively exposing the peripheral surfaces of the photosensitive drums 244*a*–244*d*. As a result, an electrostatic latent image is formed on the peripheral surface of each of the photosensitive drums 244*a*–244*d*.

As described above, the development unit 242 contains one developer among the yellow, magenta, cyan, and black developers t. The developer is coated on the peripheral surface of the development roller 251, that is, a developing member, while charging the developer. Also, development bias is applied to the development roller 251 positioned so that the peripheral surface of the development roller 251 becomes microscopically close to, and parallel to, the peripheral surface of the photosensitive drum 244 on which a latent image is present. As a result, developer is transferred onto the peripheral surface of the photosensitive drum 244, across the areas corresponding to the low potential level portions of the electrostatic latent image. Consequently, a developer image is formed (developer) on the photosensitive drum 244.

An endless belt 335 is positioned so that it remains in contact with all of the photosensitive drums 244*a*–244*d* while it is circularly driven. The belt 135 is approximately 700 mm in circumference and is formed of film with a thickness of 150 $\mu$m. It is stretched around four rollers: a driver roller 336, follower rollers 337*a* and 337*b*, and a tension roller 338, and is circularly driven in the direction indicated by an arrow mark X in the drawing. The recording medium P is kept pressed directly upon the outwardly facing surface of the belt 335 by a roller 344, and electrical voltage is applied between the belt 335 and roller 344 to induce electrical charge between the recording medium P, which is dielectric, and the dielectric layer of the belt 335. As a result, the recording medium P is electrostatically adhered to the outwardly facing surface of the belt 335, assuring that the recording medium P is conveyed, being kept properly positioned, to the interface (transfer station) between the belt 335 and the photosensitive drum 244.

Within the loop of the belt 335, transfer rollers 339*a*–339*d* are positioned, being kept in contact with the belt 335, at the points corresponding to the photosensitive drums 244*a*–244*d*, by a predetermined amount of pressure. Positive electrical charge is applied from these transfer rollers 339 to the recording medium P through the belt 335. The developer images on the photosensitive drums 244*a*–244*d*, which are negative in polarity, are transferred one after another onto the recording medium P while the recording medium P is conveyed in contact with the photosensitive drums 244*a*–244*d*, by the electrical fields generated by these electrical charges.

A conveying portion 340 is a portion for conveying the recording medium P. In a sheet feeding cassette 341, plural sheets of recording medium are stored. During an image forming operation, a feeding roller 342 is rotationally driven to feed out the plural sheets of recording medium and convey them forward, one by one, in coordination with the progression of the image forming operation. As the recording medium P is conveyed, it bumps against a pair of registration rollers 343, being thereby straightened if it were skewed. Then, the recording medium P is released to the belt 335 by the pair of registration rollers 343 in synchronism with the rotation of the belt 335, that is, in synchronism with the leading edges of the developer images on the photosensitive drums 244*a*–244*d*. More specifically, the pair of registration rollers 343 begins to be rotated with such a timing that the leading edge of the developer image on the photosensitive drum 244*a*, or the most upstream photosensitive drum, arrives at the interface between the photosensitive drum 244*a* and belt 335, at the same time as the leading edge of the recording area of the recording medium P on the belt 335 arrives at the interface between the photosensitive drum 244*a* and belt 335.

After the transfer of the developer image onto the recording medium P, the recording medium P separates from the belt 335 due to the curvature of the driving roller 336, and is conveyed into a fixing station 345, which is where the plural developer images on the recording medium P are fixed to the recording medium P. More specifically, the fixing station 345 comprises a heat roller 346, and a pressure roller 347 which is kept pressed upon the heat roller 346 to assure that heat and pressure is properly applied to the recording medium P. As the recording medium P, on which the transferred developer images are borne unfixed, is passed through the fixing station 345, the developer are melted by the heat and fixed as a full-color image to the recording medium P by the pressure. After the fixation of the developer images, or the formation of the full-color image, the recording medium P is discharged out of the apparatus main assembly through a delivery station 349 by a pair of discharge rollers 348.

(Process cartridge)

Next, referring to FIGS. 11–18, the cartridge 240 (240*a*–240*d*) in this embodiment will be described. This cartridge 240 comprises a drum unit 241, which is enclosed in the first frame portion, and a development unit 242, which is enclosed in the second frame portion. As will be described later, the two units are connected by a pair of pins so that the two units are rendered pivotal relative to each other about a pivotal axis 243 which coincides with the axes of the pair of pins.

(First frame portion)

Referring to FIG. 11, the drum unit 241 enclosed in the first frame portion contains a photosensitive drum 244, which is rotatably supported by the drum unit 241 with the use of a shaft 244*a*. In addition, the drum unit 241 contains a charge roller 245 for uniformly charging the peripheral surface of the photosensitive drum 244, a cleaning member 246 for removing the developer remaining on the photosensitive drum 244 by making contact with the photosensitive drum 244, a removed developer storing portion 247 located above a developer storing portion 252, which will be described later, and a removed developer conveying mechanism 248. Further, the drum unit 241 has a pair of holes 241*a* (FIG. 12) for connecting the drum unit 241 and development unit 242. The center lines of the holes 241*a* coincide with the pivotal axis 243.

Incidentally, a term "above" is used with reference to such a condition that the cartridge 240 is properly seated in the apparatus main assembly 350.

As described above, the developer which remains on the photosensitive drum 244 after image transfer is scraped away by the cleaning member 246, and the removed developer is conveyed into the removed developer storing portion 247 by the removed conveying mechanism 248.

The removed developer conveying mechanism 248 is provided with a developer advancing plate 249, or a removed developer conveying member, which is rotatably attached to a crank 250 rotatably supported by the removed developer storing portion 247. The crank 250 is formed of a piece of metallic rod, and has a rotational diameter of 5 mm. The rotation of the crank 250 causes the developer advancing plate 249 to reciprocally move in the direction (direction H indicated by arrow mark in FIG. 13) to convey the removed developer from the adjacencies of the cleaning member 246 to the removed developer storing portion 247. The developer advancing plate 249 is a piece of metallic plate with a thickness of 1 mm, and is provided with partitions 249*a* for conveying the developer forward.

Incidentally, a screw may be employed as the removed developer conveying member, although the developer advancing plate 249 is employed in this embodiment.

(Second frame portion)

Referring to FIG. 11, the development unit 242 enclosed in the second frame portion is provided with a development roller 251 as a developing member, a developer storing portion 252 which stores developer of relevant color, and a frame portion 254 for developing means. The developer storing portion 252 is located below the removed developer storing portion 247, and contains stirring members 253*a* and 253*b* which double as a developer sending means.

Incidentally, a term "below" is used with reference to a condition in which the cartridge 240 is properly seated in the apparatus main assembly.

The developer in the developer storing portion 252 is delivered to a developer supplying roller 255 within the developing means frame portion 254 by a stirring member 253. Then, the developer is adhered to the peripheral surface of the development roller 251, which is rotating in the clockwise direction (direction of arrow mark Y), by the developer supplying roller 255, which is rotating in the clockwise direction (direction of arrow mark Z), and a development blade 256 kept pressed upon the peripheral surface of the development roller 251. As the developer is adhered to the peripheral surface of the development roller 251, it is given electrical charge.

(Connection between first and second frame portions)

Referring to FIG. 12, the development unit 242 (second frame portion) is provided with a pair of bearing members 257 and 258, which are located at the longitudinal ends of the development unit 242 (longitudinal ends of development roller 251), one for one, for keeping the development unit 242 connected to the drum unit 241 (first frame portion). The bearing members 257 and 258 are provided with holes 257*a* and 258*a* with a bearing surface, respectively. The central axes of the holes 257*a* and 258*a* coincide with the pivotal axis 243. Through these holes 257*a* and 258*a*, pins 243*a* are inserted into the holes 241*a* with which the drum unit 241 is provided, from the outward side of the bearing members 257 and 258. As a result, the drum unit 241 and development unit 242 are connected in such a manner that they become pivotal relative to each other as shown in FIG. 14. Further, the provision of a pair of compression springs 259, which will be described later, between the two units assures that the peripheral surfaces of the photosensitive drum 244 and development roller 251 remain in contact with each other across the entire ranges of the two rollers in terms of their longitudinal directions.

More specifically, the pair of compression springs 259 are placed between the drum unit 241 and development unit 242, as shown in FIG. 11, so that the photosensitive drum 244 and development roller 251 are kept pressed upon each other by the elasticity of the compression springs 259. The pressure spring 259 is provided at each of one and the other longitudinal ends of the units 241 and 242. The spring forces are substantially the same.

(Driving force transmitting mechanism)

Next, the driving force transmitting mechanism in the cartridge 240 will be described. In this embodiment, the driving force is independently transmitted to the drum unit 241 and development unit 242 of the cartridge 240, from the apparatus main assembly.

Referring to FIG. 12, the drum unit 241 is provided with a drum driving coupling 260, as a drum driving force transmitting member on the cartridge side, which is located at the longitudinal end of the photosensitive drum 244. The axial line of the drum driving coupling 260 coincides with that of the photosensitive drum 244. To this drum driving coupling 260, a driving force is transmitted from a coupling 261, as the driving force transmitting member, on the apparatus main assembly side.

Referring to FIG. 15, the coupling 260 on the cartridge side is in the form of a twisted, approximately equilateral, and triangular pillar, whereas the coupling 261 on the main assembly side is in the form of a twisted, approximately equilateral, and triangular hole. The cartridge side coupling 260 engages into the main assembly side coupling 261 in the direction parallel to the longitudinal direction of the photosensitive drum 244. Then, as the main assembly side coupling 261 begins to rotate, the engagement of the cartridge side coupling 260 into the main assembly side coupling 261 becomes gradually deeper, following the twisted, equilateral, and triangular structures of the two coupling portions. By the time the apparatus side coupling 261 finishes rotating a maximum of 120 degrees, the two couplings fully engage with each other, and a driving force begins to be transmitted to the photosensitive drum 244. Incidentally, the rotational axis of the cartridge side coupling 260 coincides with the rotational axis of the photosensitive drum 244.

Further, the drum unit 241 has a gear 262 attached to the shaft of the crank 250 of the removed developer conveying mechanism 248, and an idler gear 263 meshes with the gear 262 (FIG. 17).

The bearing member 257, that is, the bearing member on the driven side, of the development unit 242 is provided with shafts 257*b*–254*d*, around which a gear 264, and idler gear 265 and 266, as developing means driving force transmitting members, are fitted, correspondingly. The gear 264 is a helical gear, and driving force is transmitted to this gear 264 from a helical gear 267 as a developing means driving force transmitting member on the main assembly side, as shown in FIG. 17. Incidentally, in terms of the direction perpendicular to the direction in which the cartridge 240 is inserted into the apparatus main assembly 350, the gear 246 is located at the same side of the cartridge 240 as the aforementioned cartridge side coupling 260. Also in terms of the direction perpendicular to the direction in which the cartridge 240 is inserted into the apparatus main assembly 350, the gear 264 is on the inward side the cartridge side coupling 260. Also in terms of the direction in which the cartridge 240 is inserted into the apparatus main assembly 350, the gear 264 is on the downstream side of the cartridge side coupling 260.

Incidentally, the cartridge 240 is inserted into, or removed from, the apparatus main assembly 350 in the direction perpendicular to the axial line of the photosensitive drum 244.

The axial line of the shaft 257*b* coincides with the axial line of the through hole 257*a*, the axial line of which coincides with the pivotal axis 243. The gear 264 is positioned so that its axial line coincides with the axial lines (in other words, pivotal axis 243) of the aforementioned connecting pins 243*a* by which the drum unit 241 and development unit 242 remain connected to each other.

To sum up, the cartridge 240 in this embodiment comprises: the drum unit 241; the development unit 242 connected to the drum unit 241 with the use of the pins 243*a* in such a manner that the development unit 242 is rendered pivotal about the pins 243*a*; the photosensitive drum 244 with which the drum unit 241 is provided; the development roller 251 provided in the development unit 242 to develop the electrostatic latent image formed on the photosensitive drum 244, with the use of the developer t; and the gear 264 as a developing means driving force transmitting member for receiving the driving force for rotating the development roller 251, from the apparatus main assembly 350, when the cartridge 240 is in the apparatus main assembly 350. The gear 264 is positioned in such a manner that its axial line coincides with that of the aforementioned pins 243*a*. It receives a driving force from a direction approximately perpendicular to the longitudinal direction of the development roller 251. It meshes with the aforementioned helical gear 267, that is, one of the gears on the main apparatus side, which is provided in the apparatus main assembly 350, on the downstream side with respect to the axial line of the gear 264 in terms of the direction in which the cartridge 240 is inserted into the apparatus main assembly 350. It should be noted here that as described above, the cartridge 240 is inserted into the apparatus main assembly 350 from the direction perpendicular to the axial line of the development roller 251; the gear 264 is provided in the development unit 242; the gear 264 is exposed through the opening 241*b* of the drum unit 241; and the gear 264 meshes with the helical gear 267 by the exposed portion.

Incidentally, the direction from which the cartridge side coupling 260, as a drum driving force transmitting member, receives a driving force from the apparatus main assembly 350 is perpendicular to the direction from which the gear 264 receives a driving force from the apparatus main assembly 350. With the provision of the above described structure arrangement, when the driving force is inputted into the gear 264, the moment generated about the pivotal axis 243 by the force F generated by the meshing between the helical gear 267 and gear 264 remains small. In other words, positioning the gear 264 in such a manner that the axial line of the gear 264 coincides with the axial lines of the pins 243*a* which connect the drum unit 241 and development unit 242, prevents the position of the development unit 242 from changing. This in turn prevents the backlash between the gear 264 and helical gear 267 from changing. As a result, a stable image forming operation is possible. Further, when driving force is transmitted from the apparatus main assembly 350 to the development unit 242, the moment which otherwise will be generated as the driving force inputted from the apparatus main assembly 350, is not generated, and therefore, an unsatisfactory image, the cause of which is traceable to cartridge-frame deformation, is not produced.

After being inputted into the gear 264, the driving force is divisively transmitted. In other words, a part of the driving force inputted into that is transmitted to the development roller 251, the stirring member 253, as well as the removed developer conveying mechanism 248 of the drum unit 241, by way of driving force transmitting means, or the gear trains.

More specifically, after being inputted into the gear 264, a part of the driving force is transmitted to the gear 268 attached to one end of the development roller 251, and the gear 269 attached to one end of the developer supplying roller 255, by way of the idler gear 265 and 266, which make up the first gear train, and rotates the development roller 251 and developer supplying roller 255. Incidentally, the idler gear 265 is a step gear, and reduces the rotational velocity of the driving force.

Another part of the driving force is transmitted to the developer stirring gear 270*a* of the stirring member 253*a* to rotate the stirring member 253*a*, and then is further transmitted, by way of the idler gear 271, to the developer stirring gear 270*b* of the stirring member 253*b* to rotate the stirring member 253*b*.

From the idler gear 271, the driving force is divisively transmitted. That is, a part of the driving force delivered to the idler gear 271 is transmitted to the idler gear 263 of the drum unit 241 through the idler gear 272. As described above, the idler gear 263 is meshed with the gear 262 attached to the crank 250 of the removed developer conveying mechanism 248, and therefore, transmits the driving force to the crank 250, which in turn transmits the driving force to the developer advancing plate 249. In other words, a part of the driving force inputted into the gear 264 of the development unit 242 is transmitted to the developer advancing plate 249, that is, the removed developer conveying member of the drum unit 241, by way of the driving force transmitting means, that is, the gear train (gears 265, 270*a*, 271, 272, 263 and 262), and reciprocally moves the developer advancing plate 249. The idler gears 271 and 263 are stepped, and reduce the rotational velocity of the driving force.

It should be noted here that the gears 270*a*, 271, 270*b*, 272, 262 and 263 make up the second gar trains. The gears 264, 265, 266, 268, 269, 270*a*, 270*b*, 271 and 272 are attached to development unit 242, and the gears 267, 262 and 263 are attached to the drum unit 241.

As described above, according to this embodiment, the means for driving the photosensitive drum 244 is rendered separate from the system for driving the development roller 251, the stirring member 253, and the developer advancing plate 249. Therefore, it does not occur that the fluctuations in the rotational velocity, and vibrations of the stirring member 253 and developer advancing plate 249, are directly transmitted to the photosensitive drum 244. Thus, even when the accumulation of the removed developer results in the increased load upon the developer advancing plate 249, the rotation of the photosensitive drum 244 is not affected by the increase.

Further, the development unit 242 pivots relative to the drum unit 241. Thus, the idler gear 272 of the development unit 242 also pivots relative to the idler gear 263 of the drum unit 241. Therefore, a structural arrangement is made to place the pivotal axis 243, and the axial lines of the idler gears 272 and 263 in the same plane as shown in FIG. 18. With this arrangement, the idler gears 272 and 263 do not interfere with the pivoting of the development 242 relative to the drum unit 241, and the backlash between the two gears becomes a minimum.

The cartridge 240 is provided with an handle 240*a*, which is located on the photosensitive drum side. This handle 240*a* is grasped by a user to install, or remove, the cartridge 240 into, or from, one of the aforementioned cartridge spaces 350*a*–350*d* in the direction perpendicular to the axial line of the photosensitive drum 244. Thus, in terms of the direction in which the cartridge 240 is inserted into the apparatus main assembly 350, the gear 264 is positioned on the downstream side of the cartridge side coupling 260. Also, in terms of the direction in which the cartridge 240 is inserted into the apparatus main assembly 350, the photosensitive drum 244, development roller 251, and crank 250 for driving the developer advancing plate 249, are positioned in the listed order, listing from the upstream side.

In this embodiment, the through hole 257*a*, through which the shaft for the gear 264 is put, and the center line of which coincides with the pivotal axis 243, is provided in the bearing member 257. However, a similar structure may be placed in the developing means frame portion 254, or developer storing portion 252 instead of the bearing member 257.

As described in the foregoing, according to the present invention, the deformation of the frames of the process cartridge can be effectively prevented.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to the main assembly of an electrophotographic image forming apparatus, said process cartridge comprising:

a first frame;

a second frame connected with said first frame for rotation about a shaft;

an electrophotographic photosensitive drum provided in said first frame;

a developing member, provided in said second frame, for developing an electrostatic latent image formed on said photosensitive drum with a developer; and a development driving force receiving member for receiving a driving force for rotating said developing member from a main assembly of the apparatus when said process cartridge is mounted to the main assembly of the apparatus, said development driving force receiving member being disposed coaxial with the shaft.

2. A process cartridge according to claim 1, wherein said development driving force receiving member receives the driving force in a direction substantially perpendicular to a longitudinal direction of said developing member in the form of a developing roller.

3. A process cartridge according to claim 2, wherein said development driving force receiving member includes a cartridge gear which is engageable with a main assembly gear provided in the main assembly of apparatus at a position downstream of a center of said cartridge gear with respect to a mounting direction in which said process cartridge is mounted to the main assembly of apparatus.

4. A process cartridge according to claim 3, wherein said cartridge gear is provided in said second frame and is exposed to the outside through an opening provided in said first frame so as to be engageable with the main assembly gear.

5. A process cartridge according to claim 3, wherein said cartridge gear and the main assembly gear are helical gears.

6. A process cartridge according to claim 1, further comprising a drum driving force receiving member for receiving a driving force for rotating said photosensitive drum from the main assembly of the apparatus when said process cartridge is mounted to the main assembly of the apparatus, said drum driving force receiving member receiving a driving force in a direction crossing with a direction in which said development driving force receiving member receives the driving force from the main assembly of the apparatus when said drum driving force receiving member receives the driving force from the main assembly of the apparatus.

7. A process cartridge according to claim 6, wherein said drum driving force receiving member is in the form of a coupling.

8. A process cartridge according to claim 1, wherein said development driving force receiving member is in the form of a development gear, and wherein said development gear is disposed outside said second frame at one longitudinal end of said developing member in the form of a developing roller.

9. A process cartridge according to claim 8, wherein the driving force received by the development gear is transmitted to said developing roller by a first gear train and is transmitted to a removed developer feeding member through a second gear train to rotate said removed developer feeding member, and wherein said feeding member functions to feed the developer removed from said photosensitive drum by a cleaning member.

10. A process cartridge according to claim 9, wherein said second gear train transmits the driving force to a stirring member provided in a developer accommodating portion accommodating a developer to be used for development.

11. A process cartridge according to claim 1, wherein said development driving force receiving member is disposed downstream of a drum driving force receiving member with respect to a mounting direction in which said process cartridge is mounted to the main assembly of the apparatus, wherein said development driving force receiving member and said drum driving force receiving member are provided at the same side with respect to a direction crossing with the mounting direction, and wherein said process cartridge is mounted to the main assembly of the apparatus in a direction crossing with an axial direction of said photosensitive drum.

12. A process cartridge according to claim 11, wherein said drum driving force receiving member is in the form of a coupling, and wherein said development driving force receiving member is in the form of a helical gear, and said helical gear is disposed inside said coupling with respect to a direction crossing with the mounting direction.

13. A process cartridge according to claim 11, wherein said development driving force receiving member is disposed downstream of said drum driving force receiving member, and said photosensitive drum, said developing member in the form of a developing roller, a crank for driving said removed developer feeding member are disposed in the order named from an upstream side toward a downstream side with respect to the mounting direction, and wherein said feeding member functions to feed the developer removed from said photosensitive drum by a cleaning member.

14. A process cartridge according to claim 13, wherein said first frame includes a developer accommodating portion accommodating the developer to be used for development, and wherein there is provided a removed developer accommodating portion for accommodating a removed developer removed from said photosensitive drum by a cleaning member at a position above said developer accommodating portion when said process cartridge is mounted to the main assembly of the apparatus, and said feeding member is disposed in said removed developer accommodating portion.

15. A process cartridge according to claim 6, wherein said drum driving force receiving member is in the form of a coupling and is engageable with a main assembly coupling provided in the main assembly of the apparatus in a longitudinal direction of said photosensitive drum to receive a driving force for rotating said photosensitive drum.

16. A process cartridge according to claim 7 or 15, wherein said coupling is a form of a twisted substantially triangular prism, and the main assembly coupling is a twisted hole having a substantially triangular cross-section, and wherein said substantially triangular prism and said hole are engaged to transmit the driving force.

17. A process cartridge detachably mountable to the main assembly of an electrophotographic image forming apparatus, said process cartridge comprising:

a first frame disposed such that it takes an upper position when said process cartridge is mounted to the main assembly of the apparatus;

a second frame connected with said first frame for rotation about a shaft;

an electrophotographic photosensitive drum provided in said first frame;

a developing roller, provided in said second frame, for developing an electrostatic latent image formed on said photosensitive drum with a developer, said second frame being disposed such that it takes a lower position when said process cartridge is mounted to the main assembly of the apparatus;

a developer accommodating portion provided in said second frame and accommodating the developer;

a cleaning member, provided in said second frame, for removing the developer remaining on said photosensitive drum;

a removed developer accommodating portion, provided in said first frame, for accommodating the developer removed by said cleaning member, wherein said removed developer accommodating portion is disposed such that it is above said developer accommodating portion when said process cartridge is mounted to the main assembly of the apparatus;

a coupling, provided in said first frame, for receiving from the main assembly of the apparatus a driving force for rotating said photosensitive drum when said process cartridge is mounted to the main assembly of the apparatus, said coupling being coaxial with said photosensitive drum; and a helical gear, provided in said second frame, for receiving a driving force for rotating said developing member from the main assembly of the apparatus when said process cartridge is mounted to the main assembly of the apparatus, wherein said helical gear is disposed downstream of said coupling in a mounting direction in which said process cartridge is mounted to the main assembly of the apparatus, and said helical gear is disposed coaxial with said shaft, and is disposed inside said coupling in the direction crossing with the mounting direction;

wherein said photosensitive drum and said developing roller are disposed in the order named from an upstream side toward a downstream side in the mounting direction, and wherein said helical gear and said coupling are disposed at the same end with respect to a direction crossing with the mounting direction, and said process cartridge is mounted to the main assembly of the apparatus in a direction crossing with an axial direction of said photosensitive drum.

18. A process cartridge according to claim 17, wherein said coupling is a form of a twisted substantially triangular prism, and the main assembly coupling is a twisted hole having a substantially triangular cross-section, and wherein said substantially triangular prism and said hole are engaged to transmit the driving force.

19. A process cartridge according to claim 14 or 17, wherein said developer accommodating portion accommodates the developer.

20. An electrophotographic image forming apparatus for forming an image on the recording material, to which a process cartridge is detachably mountable, said apparatus comprising:

(a) a main assembly development driving force transmitting member;

(b) a mounting portion for detachably mounting a process cartridge, said process cartridge including:

a first frame;

a second frame connected with said first frame for rotation about a shaft;

an electrophotographic photosensitive drum provided in said first frame;

a developing member, provided in said second frame, for developing an electrostatic latent image formed on said photosensitive drum with a developer; and a development driving force receiving member for receiving a driving force for rotating said developing member from said main assembly of development driving force transmitting member when said process cartridge is mounted to the main assembly of the apparatus, said development driving force receiving member being disposed coaxial with the shaft.

21. An electrophotographic image forming apparatus for forming an image on the recording material, to which a process cartridge is detachably mountable, said apparatus comprising:

(a) a main assembly coupling;

(b) a main assembly helical gear; and (c) a mounting portion for detachably mounting a process cartridge, said process cartridge including:

a first frame disposed such that it takes an upper position when said process cartridge is mounted to the main assembly of the apparatus;

a second frame connected with said first frame for rotation about a shaft;

an electrophotographic photosensitive drum provided in said first frame;

a developing roller, provided in said second frame, for developing an electrostatic latent image formed on said photosensitive drum with a developer, said second frame being disposed such that it takes a lower position when said process cartridge is mounted to the main assembly of the apparatus;

a developer accommodating portion provided in said second frame and accommodating the developer;

a cleaning member, provided in said second frame, for removing the developer remaining on said photosensitive drum;

a removed developer accommodating portion, provided in said first frame, for accommodating the developer removed by said cleaning member, wherein said removed developer accommodating portion is disposed such that it is above said developer accommodating portion when said process cartridge is mounted to the main assembly of the apparatus;

a coupling, provided in said first frame, for receiving from the main assembly coupling a driving force for rotating said photosensitive drum when said process cartridge is mounted to the main assembly of the apparatus, said coupling being coaxial with said photosensitive drum; and a helical gear, provided in said second frame, for receiving a driving force for rotating said developing member from the main assembly helical gear when said process cartridge is mounted to the main assembly of the apparatus, wherein said helical gear is disposed downstream of said coupling in a mounting direction in which said process cartridge is mounted to the main assembly of apparatus, and said helical gear is disposed to coaxial with said shaft, and is disposed inside said coupling in the direction crossing with the mounting direction;

wherein said photosensitive drum and said developing roller are disposed in the order named from an upstream side toward a downstream side in the mounting direction, and wherein said helical gear and said coupling are disposed at the same end with respect to a direction crossing with the mounting direction, and said process cartridge is mounted to the main assembly of the apparatus in a direction crossing with an axial direction of said photosensitive drum.

* * * * *

UNITED STATES PATENT AND TRADEMARK OFFICE

CERTIFICATE OF CORRECTION

PATENT NO. : 6,459,869 B2
DATED : October 1, 2002
INVENTOR(S) : Susumu Nittani et al.

It is certified that error appears in the above-identified patent and that said Letters Patent is hereby corrected as shown below:

Column 2,
Line 45, “above described” should read -- above-described --.
Line 61, “to” should be deleted
Line 62, “provide” should be deleted Column 5,
Line 10, “image” (second occurrence) should be deleted Column 7,
Line 21, “sing” should read -- swing --.

Column 11,
Line 4, “including;” should read -- including: --.

Column 17,
Line 43, “above described” should read -- above-described --.

Column 18,
Line 35, “gar” should read -- gear --.

Column 24,
Line 3, “apparatus” should read -- the apparatus --.

Signed and Sealed this

Thirteenth Day of May, 2003

JAMES E. ROGAN
*Director of the United States Patent and Trademark Office*